US012448852B2

(12) United States Patent
Rivera, Jr. et al.

(10) Patent No.: US 12,448,852 B2
(45) Date of Patent: Oct. 21, 2025

(54) FIXED CUTTER DRILL BITS AND CUTTER ELEMENT WITH SECONDARY CUTTING EDGES FOR SAME

(71) Applicant: National Oilwell Varco, L.P., Houston, TX (US)

(72) Inventors: Richard Rivera, Jr., Conroe, TX (US); Tom S. Roberts, Montgomery, TX (US); Russell W. Cowart, Conroe, TX (US)

(73) Assignee: NATIONAL OILWELL VARCO, L.P., Houston, TX (US)

( * ) Notice: Subject to any disclaimer, the term of this patent is extended or adjusted under 35 U.S.C. 154(b) by 0 days.

(21) Appl. No.: 18/199,668

(22) Filed: May 19, 2023

(65) Prior Publication Data

US 2023/0374866 A1 Nov. 23, 2023

Related U.S. Application Data

(60) Provisional application No. 63/343,946, filed on May 19, 2022.

(51) Int. Cl.
*E21B 10/567* (2006.01)

(52) U.S. Cl.
CPC ..... *E21B 10/5673* (2013.01)

(58) Field of Classification Search
CPC ..... E21B 10/5671; E21B 10/5673
See application file for complete search history.

(56) References Cited

U.S. PATENT DOCUMENTS 4,984,642 A * 1/1991 Renard ..... E21B 10/5673 175/430
5,172,778 A 12/1992 Tibbitts et al.
6,045,440 A * 4/2000 Johnson ..... E21B 10/5673 451/540

(Continued)

FOREIGN PATENT DOCUMENTS

EP 0918135 A1 5/1999
GB 2318140 A 4/1998

(Continued)

OTHER PUBLICATIONS

PCT/US2023/022916 International Search Report and Written Opinion dated Jul. 17, 2023 (15 p.).

*Primary Examiner* — D. Andrews
(74) *Attorney, Agent, or Firm* — CONLEY ROSE, P.C.

(57) ABSTRACT

A cutter element for a fixed cutter drill bit configured to drill a borehole in a subterranean formation includes a base having a central axis, a first end, a second end, and a radially outer cylindrical surface extending axially from the first end to the second end. In addition, the cutter element includes a cutting layer fixably mounted to the first end of the base. The cutting layer includes a stepped cutting face distal the base and a radially outer cylindrical surface extending axially from the cutting face to the radially outer cylindrical surface of the base. The radially outer cylindrical surface of the cutting layer is contiguous with the radially outer cylindrical surface of the base. The stepped cutting face includes a first step, a second step axially spaced from the first step, and a riser axially positioned between the first step and the second step. The first step is axially positioned between the riser and the base.

26 Claims, 17 Drawing Sheets

(56) References Cited

U.S. PATENT DOCUMENTS

| | | | |
|---|---|---|---|
| 6,904,984 | B1 | 6/2005 | Estes et al. |
| 2011/0031036 | A1 | 2/2011 | Patel |
| 2020/0018122 | A1 | 1/2020 | Keller et al. |
| 2020/0224501 | A1 | 7/2020 | Dubose et al. |
| 2021/0131190 | A1* | 5/2021 | Rahmani ..... E21B 10/42 |
| 2022/0017798 | A1 | 1/2022 | Haijiang et al. |

FOREIGN PATENT DOCUMENTS

| | | | |
|---|---|---|---|
| WO | 2008/095005 | A1 | 8/2008 |
| WO | 2014/052372 | A2 | 4/2014 |

* cited by examiner

FIXED CUTTER DRILL BITS AND CUTTER ELEMENT WITH SECONDARY CUTTING EDGES FOR SAME

CROSS-REFERENCE TO RELATED APPLICATIONS

This application claims benefit of U.S. provisional patent application Ser. No. 63/343,946 filed May 19, 2022, and entitled "Fixed Cutter Drill Bits and Cutter Elements with Secondary Cutting Edges for Same," which is hereby incorporated herein by reference in its entirety.

STATEMENT REGARDING FEDERALLY SPONSORED RESEARCH OR DEVELOPMENT

Not applicable.

BACKGROUND

The present disclosure relates generally to earth-boring bits used to drill a borehole for the ultimate recovery of oil, gas or minerals. More particularly, the disclosure relates to fixed cutter drill bits with improved cutter element. Still more particularly, the disclosure relates to fixed cutter drill bits including cutter elements with cutting face geometries including multiple cutting edges.

An earth-boring drill bit is typically mounted on the lower end of a drill string and is rotated by rotating the drill string at the surface or by actuation of downhole motors or turbines, or by both methods. With weight applied to the drill string, the rotating drill bit engages the earthen formation and proceeds to form a borehole along a predetermined path toward a target zone. The borehole thus created has a diameter generally equal to the diameter or "gage" of the drill bit.

Fixed cutter bits, also known as rotary drag bits, are one type of drill bit commonly used to drill boreholes. Fixed cutter bit designs include a plurality of blades angularly spaced about a bit face. The blades generally project radially outward along the bit face and form flow channels therebetween. Cutter elements are typically grouped and mounted on the blades. The configuration or layout of the cutter elements on the blades may vary widely, depending on a number of factors. One of these factors is the formation itself, as different cutter element layouts engage and cut the various strata with differing results and effectiveness.

The cutter elements disposed on the several blades of a fixed cutter bit are typically formed of extremely hard materials and include a layer of polycrystalline diamond ("PD") material. In the typical fixed cutter bit, each cutter element includes an elongate and generally cylindrical support member that is received and secured in a pocket formed in the surface of one of the several blades. In addition, each cutter element typically has a hard cutting layer of polycrystalline diamond or other superabrasive material such as cubic boron nitride, thermally stable diamond, polycrystalline cubic boron nitride, or ultrahard tungsten carbide (meaning a tungsten carbide material having a wear-resistance that is greater than the wear-resistance of the material forming the substrate), as well as mixtures or combinations of these materials. The cutting layer is mounted to one end of the corresponding support member, which is typically formed of tungsten carbide.

While the bit is rotated, drilling fluid is pumped through the drill string and directed out of the face of the drill bit. The fixed cutter bit typically includes nozzles or fixed ports spaced about the bit face that serve to inject drilling fluid into the passageways between the several blades. The drilling fluid exiting the face of the bit through nozzles or ports performs several functions. In particular, the fluid removes formation cuttings (for example, rock chips) from the cutting structure of the drill bit. Otherwise, accumulation of formation cuttings on the cutting structure may reduce or prevent the penetration of the drill bit into the formation. In addition, the fluid removes formation cuttings from the bottom of the hole. Failure to remove formation materials from the bottom of the hole may result in subsequent passes by cutting structure to essentially re-cut the same materials, thereby reducing the effective cutting rate and potentially increasing wear on the cutting surfaces of the cutter elements. The drilling fluid flushes the cuttings removed from the bit face and from the bottom of the hole radially outward and then up the annulus between the drill string and the borehole sidewall to the surface. Still further, the drilling fluid removes heat, caused by contact with the formation, from the cutter elements to prolong cutter element life.

BRIEF SUMMARY OF THE DISCLOSURE

Embodiments of cutter elements for fixed cutter bits configured to drill boreholes in subterranean formations are disclosed herein. In one embodiment, a cutter element for a fixed cutter drill bit configured to drill a borehole in a subterranean formation comprises a base having a central axis, a first end, a second end, and a radially outer cylindrical surface extending axially from the first end to the second end. In addition, the cutter element comprises a cutting layer fixably mounted to the first end of the base. The cutting layer includes a stepped cutting face distal the base and a radially outer cylindrical surface extending axially from the cutting face to the radially outer cylindrical surface of the base. The radially outer cylindrical surface of the cutting layer is contiguous with the radially outer cylindrical surface of the base. The stepped cutting face comprises a first step, a second step axially spaced from the first step, and a riser axially positioned between the first step and the second step. The first step is axially positioned between the riser and the base.

In another embodiment disclosed herein, a cutter element for a fixed cutter drill bit comprises a substrate having a central axis, a first end, a second end, and a radially outer cylindrical surface extending axially from the first end to the second end. In addition, the cutter element comprises a cutting layer having a first end distal the substrate, a second end fixably attached to the first end of the substrate, and a radially outer cylindrical surface extending from the first end of the cutting layer to the second end of the cutting layer. The first end of the cutting layer includes a stepped cutting face. The radially outer cylindrical surface of the cutting layer is contiguous with the radially outer cylindrical surface of the base. The stepped cutting face comprises a primary cutting surface extending from a first cutting tip of the cutter element. The first cutting tip is configured to engage and shear the subterranean formation. The first cutting tip is positioned at an intersection of the primary cutting surface and a first bevel. The stepped cutting face also comprises a secondary cutting surface axially spaced from the primary cutting surface. The secondary cutting surface extends from a second cutting tip of the cutter element. The second cutting tip is configured to engage and shear the subterranean formation. The second cutting tip is positioned at an intersection of the secondary cutting surface and a second bevel. Further, the stepped cutting face comprises a riser axially positioned between the primary cutting surface and the secondary cutting surface. The primary cutting surface is axially positioned between the secondary cutting surface and the substrate. The primary cutting surface is configured to engage and shear the subterranean formation before the secondary cutting surface.

Embodiments described herein comprise a combination of features and advantages intended to address various shortcomings associated with certain prior devices, systems, and methods. The foregoing has outlined rather broadly the features and technical advantages of the invention in order that the detailed description of the invention that follows may be better understood. The various characteristics described herein, as well as other features, will be readily apparent to those skilled in the art upon reading the following detailed description, and by referring to the accompanying drawings. It should be appreciated by those skilled in the art that the conception and the specific embodiments disclosed may be readily utilized as a basis for modifying or designing other structures for carrying out the same purposes of the invention. It should also be realized by those skilled in the art that such equivalent constructions do not depart from the spirit and scope of the invention as set forth in the appended claims.

BRIEF DESCRIPTION OF THE DRAWINGS

For a detailed description of the preferred embodiments of the invention, reference will now be made to the accompanying drawings in which.

DETAILED DESCRIPTION OF SOME OF THE PREFERRED EMBODIMENTS

Figure 1:
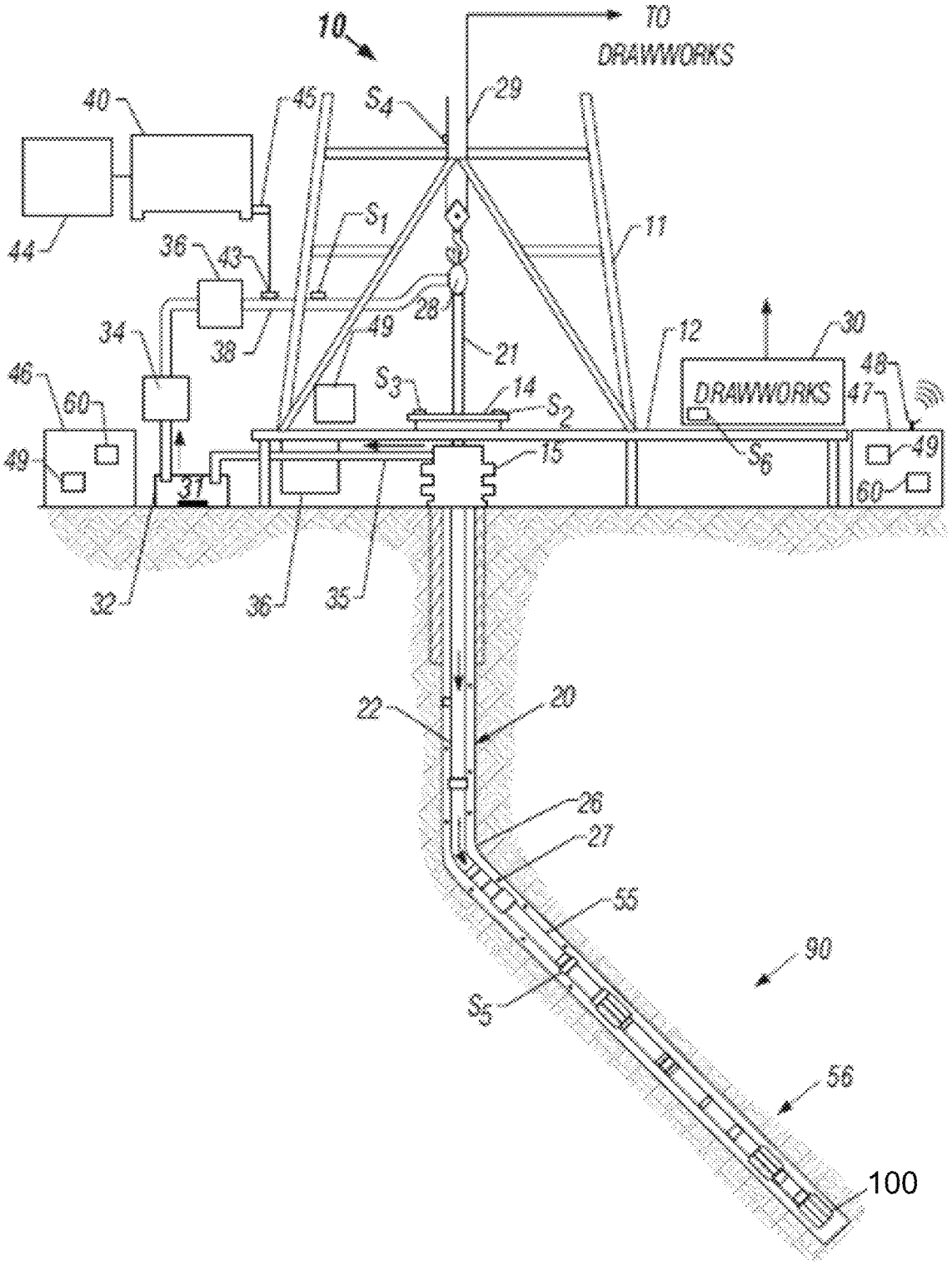
FIG. 1 is a schematic view of a drilling system including an embodiment of a drill bit in accordance with the principles described herein.

The following discussion is directed to various embodiments of the invention. Although one or more of these embodiments may be preferred, the embodiments disclosed should not be interpreted, or otherwise used, as limiting the scope of the disclosure, including the claims. In addition, one skilled in the art will understand that the following description has broad application, and the discussion of any embodiment is meant only to be exemplary of that embodiment, and not intended to intimate that the scope of the disclosure, including the claims, is limited to that embodiment.

Certain terms are used throughout the following description and claims to refer to particular features or components. As one skilled in the art will appreciate, different persons may refer to the same feature or component by different names. This document does not intend to distinguish between components or features that differ in name but not function. The drawing figures are not necessarily to scale. Certain features and components herein may be shown exaggerated in scale or in somewhat schematic form and some details of conventional elements may not be shown in interest of clarity and conciseness.

Unless the context dictates the contrary, all ranges set forth herein should be interpreted as being inclusive of their endpoints, and open-ended ranges should be interpreted to include only commercially practical values. Similarly, all lists of values should be considered as inclusive of intermediate values unless the context indicates the contrary.

In the following discussion and in the claims, the terms "including" and "comprising" are used in an open-ended fashion, and thus should be interpreted to mean "including, but not limited to . . . ." Also, the term "couple" or "couples" is intended to mean either an indirect or direct connection. Thus, if a first device couples to a second device, that connection may be through a direct engagement between the two devices, or through an indirect connection that is established via other devices, components, nodes, and connections. In addition, as used herein, the terms "axial" and "axially" generally mean along or parallel to a particular axis (for example, central axis of a body or a port), while the terms "radial" and "radially" generally mean perpendicular to a particular axis. For instance, an axial distance refers to a distance measured along or parallel to the axis, and a radial distance means a distance measured perpendicular to the axis. Any reference to up or down in the description and the claims is made for purposes of clarity, with "up", "upper", "upwardly", "uphole", or "upstream" meaning toward the surface of the borehole and with "down", "lower", "downwardly", "downhole", or "downstream" meaning toward the terminal end of the borehole, regardless of the borehole orientation. As used herein, the terms "approximately," "about," "substantially," and the like mean within 10% (plus or minus 10%) of the recited value. Thus, for example, a recited angle of "about 80 degrees" refers to an angle ranging from 72 degrees to 88 degrees.

Without regard to the type of bit, the cost of drilling a borehole for recovery of hydrocarbons may be very high, and is proportional to the length of time it takes to drill to the desired depth and location. The time required to drill the well, in turn, is greatly affected by the number of times the drill bit must be changed before reaching the targeted formation. This is the case because each time the bit is changed, the entire string of drill pipe, which may be miles long, must be retrieved from the borehole, section by section. Once the drill string has been retrieved and the new bit installed, the bit must be lowered to the bottom of the borehole on the drill string, which again must be constructed section by section. This process, known as a "trip" of the drill string, requires considerable time, effort and expense. Accordingly, it is desirable to employ drill bits which will drill faster and longer.

The length of time that a drill bit may be employed before it must be changed depends upon a variety of factors. These factors include the bit's rate of penetration ("ROP"), as well as its durability or ability to maintain a high or acceptable ROP. Two factors that significantly affects bit ROP and durability are the cutting efficiency of the cutter elements of the drill bit during drilling and the surface area of leached diamond of the cutter elements exposed to the formation during drilling. Accordingly, embodiments of drill bits described herein and the associated cutter elements offer the potential to improve cutting efficiency during drilling and increase the surface area of leached diamond exposed to the formation during drilling.

Referring now to FIG. 1, a schematic view of an embodiment of a drilling system 10 in accordance with the principles described herein is shown. Drilling system 10 includes a derrick 11 having a floor 12 supporting a rotary table 14 and a drilling assembly 90 for drilling a borehole 26 from derrick 11. Rotary table 14 is rotated by a prime mover such as an electric motor (not shown) at a desired rotational speed and controlled by a motor controller (not shown). In other embodiments, the rotary table (for example, rotary table 14) may be augmented or replaced by a top drive suspended in the derrick (for example, derrick 11) and connected to the drillstring (for example, drillstring 20).

Drilling assembly 90 includes a drillstring 20 and a drill bit 100 coupled to the lower end of drillstring 20. Drillstring 20 is made of a plurality of pipe joints 22 connected end-to-end, and extends downward from the rotary table 14 through a pressure control device 15, such as a blowout preventer (BOP), into the borehole 26. The pressure control device 15 is commonly hydraulically powered and may contain sensors for detecting certain operating parameters and controlling the actuation of the pressure control device 15. Drill bit 100 is rotated with weight-on-bit (WOB) applied to drill the borehole 26 through the earthen formation. Drillstring 20 is coupled to a drawworks 30 via a kelly joint 21, swivel 28, and line 29 through a pulley. During drilling operations, drawworks 30 is operated to control the WOB, which impacts the rate-of-penetration of drill bit 100 through the formation. In this embodiment, drill bit 100 can be rotated from the surface by drillstring 20 via rotary table 14 or a top drive, rotated by downhole mud motor 55 disposed along drillstring 20 proximal bit 100, or combinations thereof (for example, rotated by both rotary table 14 via drillstring 20 and mud motor 55, rotated by a top drive and the mud motor 55, etc.). For example, rotation via downhole motor 55 may be employed to supplement the rotational power of rotary table 14, if required, or to effect changes in the drilling process. In either case, the rate-of-penetration (ROP) of the drill bit 100 into the borehole 26 for a given formation and a drilling assembly largely depends upon the WOB and the rotational speed of bit 100.

During drilling operations, a suitable drilling fluid 31 is pumped under pressure from a mud tank 32 through the drillstring 20 by a mud pump 34. Drilling fluid 31 passes from the mud pump 34 into the drillstring 20 via a desurger 36, fluid line 38, and the kelly joint 21. The drilling fluid 31 pumped down drillstring 20 flows through mud motor 55 and is discharged at the borehole bottom through nozzles in face of drill bit 100, circulates to the surface through an annular space 27 radially positioned between drillstring 20 and the sidewall of borehole 26, and then returns to mud tank 32 via a solids control system 36 and a return line 35. Solids control system 36 may include any suitable solids control equipment known in the art including, without limitation, shale shakers, centrifuges, and automated chemical additive systems. Control system 36 may include sensors and automated controls for monitoring and controlling, respectively, various operating parameters such as centrifuge rpm. It should be appreciated that much of the surface equipment for handling the drilling fluid is application specific and may vary on a case-by-case basis.

Figure 2:
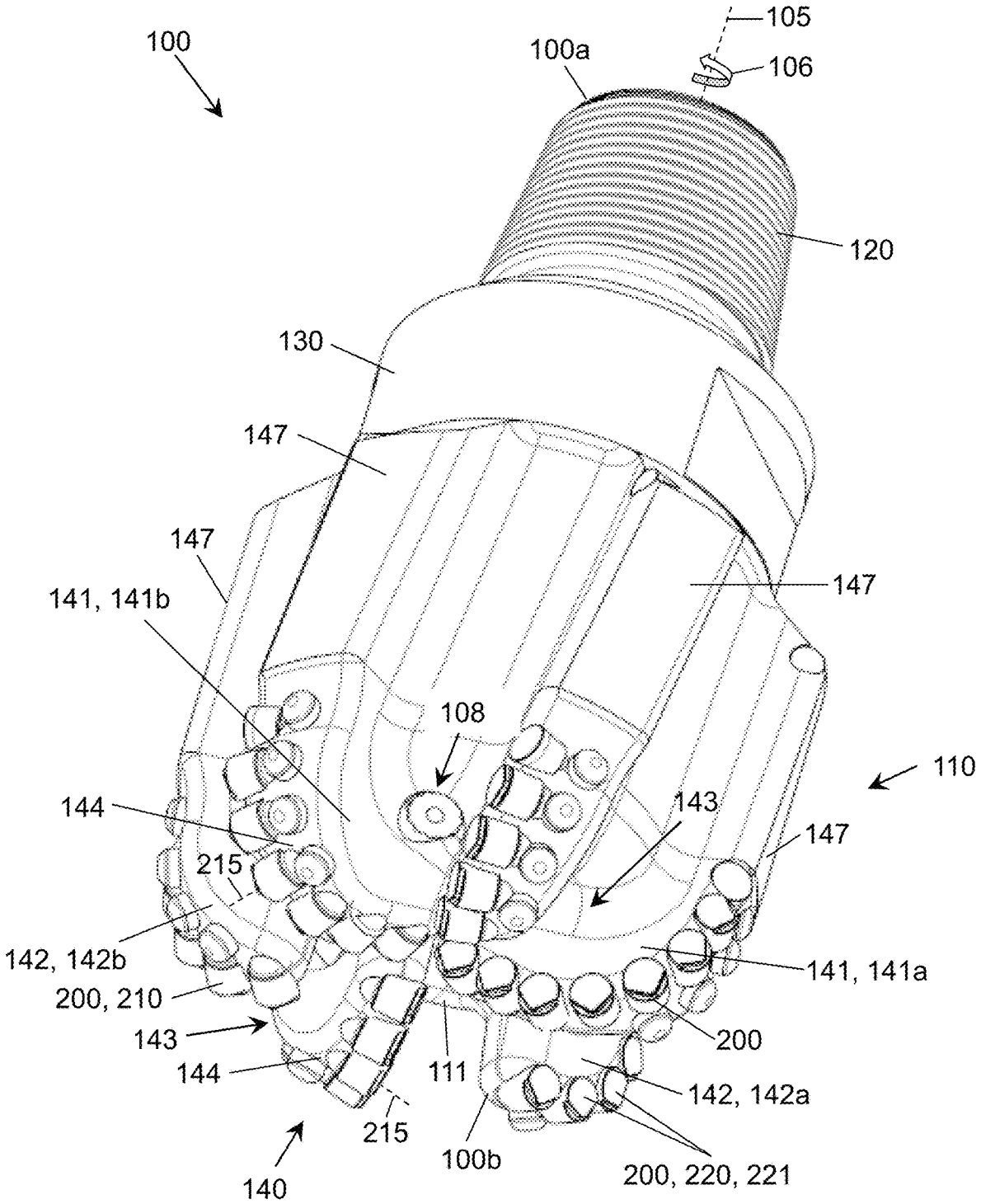
FIG. 2 is a perspective view of the drill bit of FIG. 1.
Figure 3:
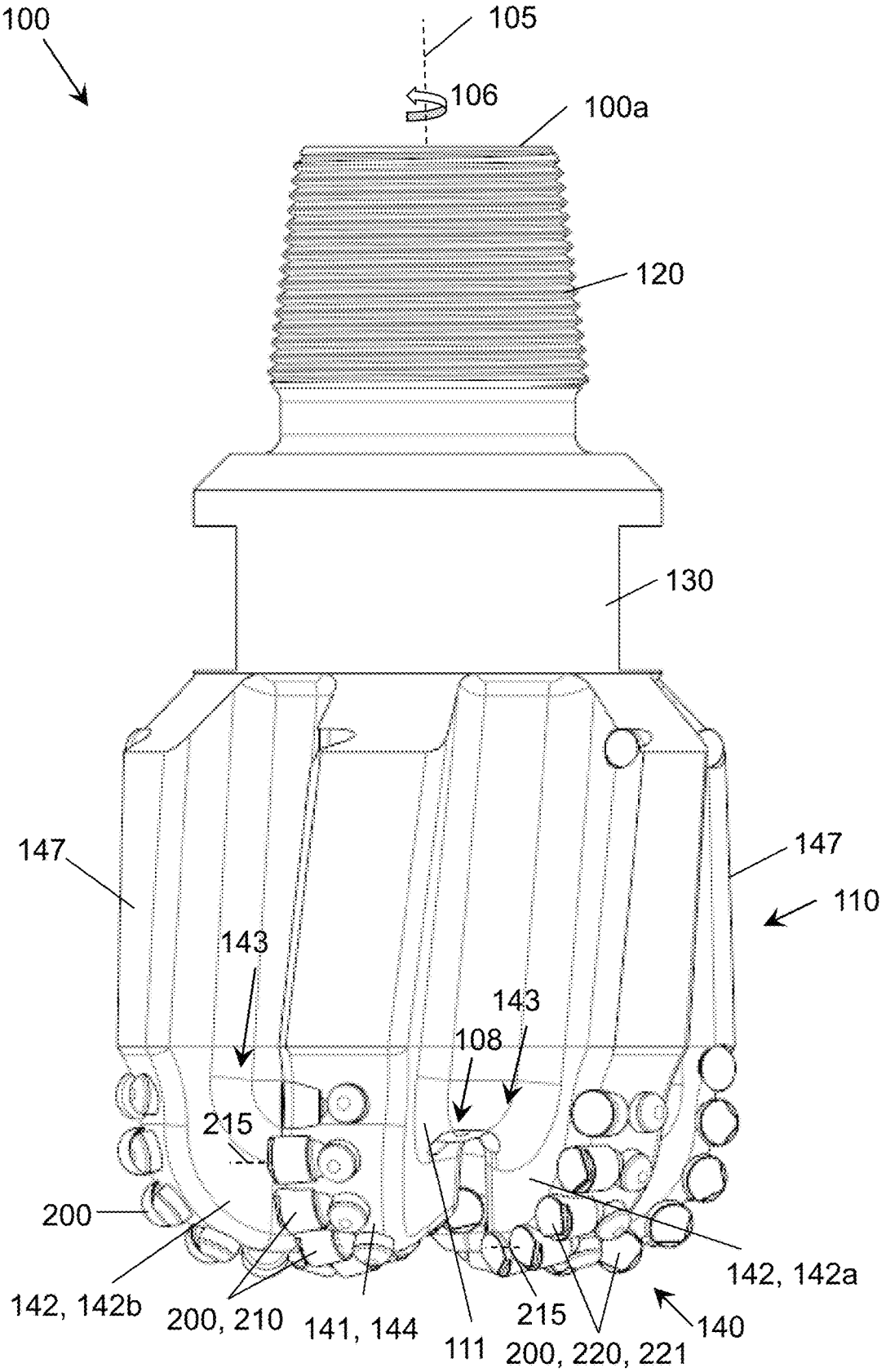
FIG. 3 is a side view of the drill bit of FIG. 2.
Figure 4:
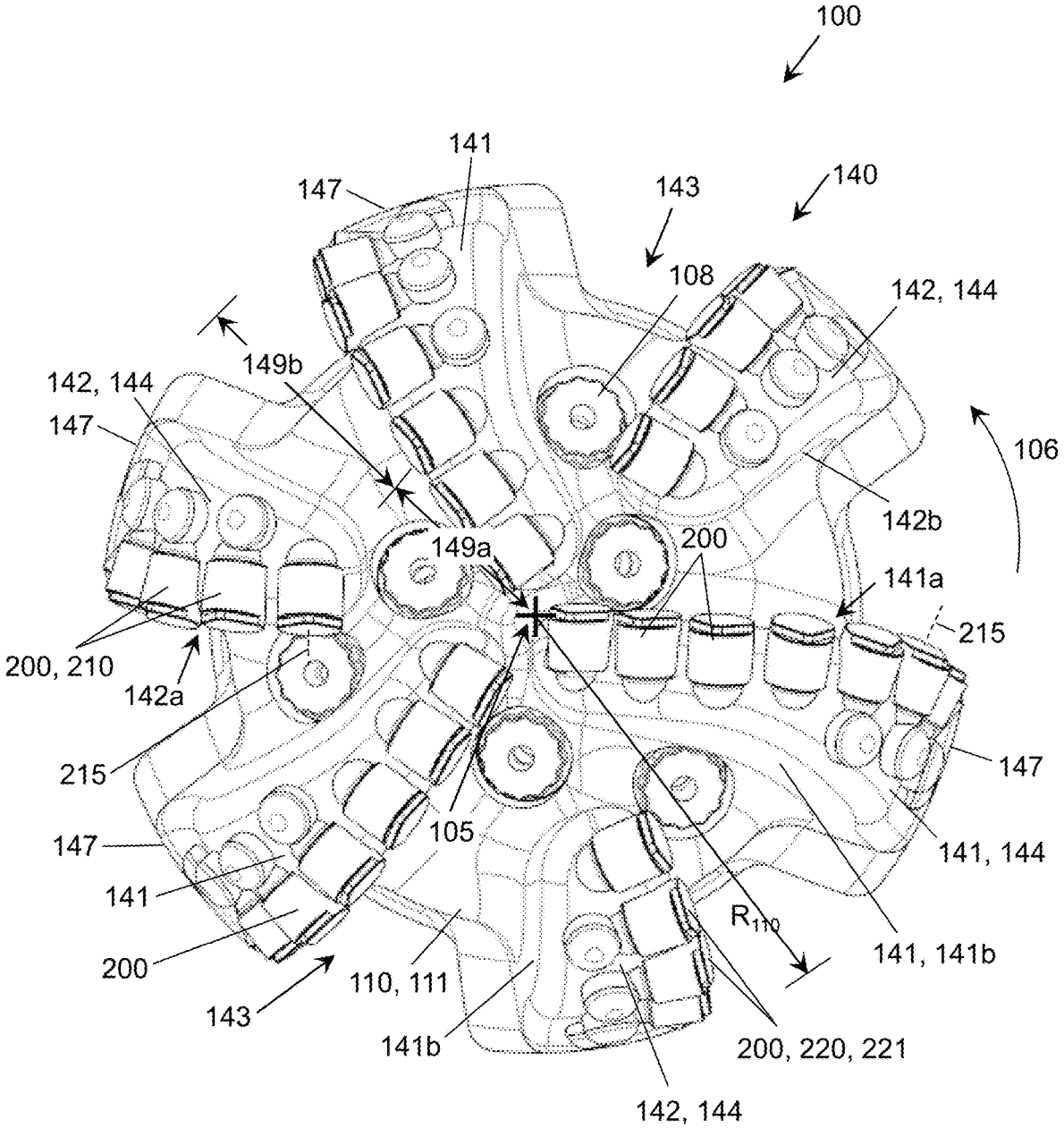
FIG. 4 is an end view of the drill bit of FIG. 2.

Referring now to FIGS. 2-4, drill bit 100 is a fixed cutter bit, sometimes referred to as a drag bit, and is designed for drilling through formations of rock to form a borehole. Bit 100 has a central or longitudinal axis 105, a first or uphole end 100*a*, and a second or downhole end 100*b*. Bit 100 rotates about axis 105 in the cutting direction represented by arrow 106. In addition, bit 100 includes a bit body 110 extending axially from downhole end 100*b*, a threaded connection or pin 120 extending axially from uphole end 100*a*, and a shank 130 extending axially between pin 120 and body 110. Pin 120 couples bit 100 to a drill string (not shown), which is employed to rotate the bit 100 in order to drill the borehole. Bit body 110, shank 130, and pin 120 are coaxially aligned with axis 105, and thus, each has a central axis coincident with axis 105.

The portion of bit body 110 that faces the formation at downhole end 100*b* includes a bit face 111 provided with a cutting structure 140. Cutting structure 140 includes a plurality of blades that extend from bit face 111. As best shown in FIG. 4, in this embodiment, cutting structure 140 includes three angularly spaced-apart primary blades 141 and three angularly spaced apart secondary blades 142. Further, in this embodiment, the plurality of blades (for example, primary blades 141, and secondary blades 142) are uniformly angularly spaced on bit face 111 about bit axis 105. In particular, the three primary blades 141 are uniformly angularly spaced about 120° apart, the three secondary blades 142 are uniformly angularly spaced about 120° apart, and each primary blade 141 is angularly spaced about 60° from each circumferentially adjacent secondary blade 142. In other embodiments, one or more of the blades may be spaced non-uniformly about bit face 111. Still further, in this embodiment, the primary blades 141 and secondary blades 142 are circumferentially arranged in an alternating fashion. In other words, one secondary blade 142 is disposed between each pair of circumferentially-adjacent primary blades 141. Although bit 100 is shown as having three primary blades 141 and three secondary blades 142, in general, bit 100 may comprise any suitable number of primary and secondary blades. As one example only, bit 100 may comprise two primary blades and four secondary blades.

Referring again to FIGS. 2-4, in this embodiment, primary blades 141 and secondary blades 142 are integrally formed as part of, and extend from, bit body 110 and bit face 111. Primary blades 141 and secondary blades 142 extend generally radially along bit face 111 and then axially along a portion of the periphery of bit 100. In particular, primary blades 141 extend radially from proximal central axis 105 toward the periphery of bit body 110. Primary blades 141 and secondary blades 142 are separated by drilling fluid flow courses 143. Each blade 141, 142 has a leading edge or side 141*a*, 142*a*, respectively, and a trailing edge or side 141*b*, 142*b*, respectively, relative to the direction of rotation 106 of bit 100.

Referring still to FIGS. 2-4, each blade 141, 142 includes a cutter-supporting surface 144 that generally faces the formation during drilling and extends circumferentially from the leading side 141*a* to the trailing side 142 of the corresponding blade 141, 142. In this embodiment, a plurality of cutter elements 200 are fixably mounted to cutter supporting surface 144 of each blade 141, 142. Cutter elements 200 are generally arranged adjacent one another in a radially extending row proximal the leading edge 141*a* of each primary blade 141 and each secondary blade 142. However, in other embodiments, the cutter elements (for example, cutter elements 200) may be arranged differently or arranged with cutter elements having different geometries.

As will be described in more detail below, each cutter element 200 includes an elongated and generally cylindrical support base or substrate 210 and a cylindrical disk or tablet-shaped, hard cutting layer 220 of polycrystalline diamond or other superabrasive material bonded to the exposed end of substrate 210. Substrate 210 has a central axis 215, and is received and secured in a pocket formed in cutter supporting surface 144 of the corresponding blade 141, 142 to which it is fixably mounted. The cylindrical disc, hard cutting layer 220 defines a cutting face 221 of the corresponding cutter element 200. As will be described in more detail below, in this embodiment, each cutting face 221 is the same and is not completely planar, but rather, includes a plurality of distinct, spaced planar surfaces that intersect a plurality of distinct, spaced cutting edges along the cutting face 221. As used herein, the phrase "non-planar" may be used to refer to a cutting face that includes one or more curved surfaces (for example, concave surface(s), convex surface(s), or combinations thereof), a plurality of distinct planar surfaces that intersect at distinct edges along the cutting face, or both. Accordingly, cutting face 221 may also be referred to herein as non-planar cutting face 221.

In the embodiments described herein, each cutter element 200 is mounted such that the corresponding central axis 215 is substantially parallel to or at an acute angle relative to the cutting direction of the bit (for example, cutting direction 106 of bit 100). Such orientation results in the corresponding cutting face 221 being generally forward-facing relative to the cutting direction of the bit (for example, cutting direction 106 of bit 100).

Referring still to FIGS. 2-4, bit body 110 further includes gage pads 147 of substantially equal axial length measured generally parallel to bit axis 105. Gage pads 147 are circumferentially-spaced about the radially outer surface of bit body 110. Specifically, one gage pad 147 intersects and extends from each blade 141, 142. In this embodiment, gage pads 147 are integrally formed as part of the bit body 110. In general, gage pads 147 can help maintain the size of the borehole by a rubbing action when cutter elements 200 wear slightly under gage. Gage pads 147 also help stabilize bit 100 against vibration.

Figure 5:
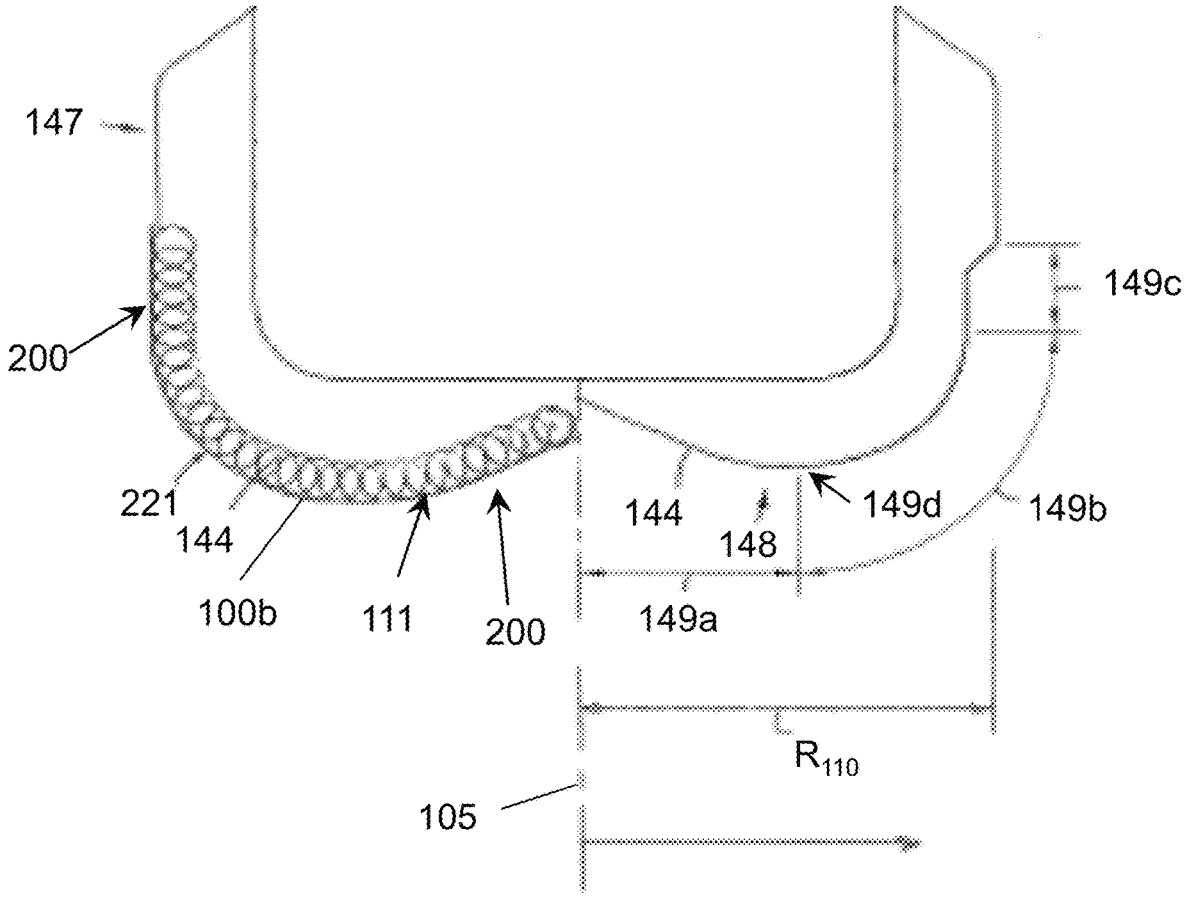
FIG. 5 is a partial cross-sectional schematic view of the bit shown in FIG. 2 with the blades and the cutting faces of the cutter elements rotated into a single composite profile.

Referring now to FIG. 5, an exemplary profile of blades 141, 142 is shown as it would appear with blades 141, 142 and cutting faces 221 rotated into a single rotated profile. In rotated profile view, blades 141, 142 form a combined or composite blade profile 148 generally defined by cutter-supporting surfaces 144 of blades 141, 142. In this embodiment, the profiles of surfaces 144 of blades 141, 142 are generally coincident with each other, thereby forming a single composite blade profile 148.

Composite blade profile 148 and bit face 111 may generally be divided into three regions conventionally labeled cone region 149*a*, shoulder region 149*b*, and gage region 149*c*. Cone region 149*a* is the radially innermost region of bit body 110 and composite blade profile 148 that extends from bit axis 105 to shoulder region 149*b*. In this embodiment, cone region 149*a* is generally concave. Adjacent cone region 149*a* is generally convex shoulder region 149*b*. The transition between cone region 149*a* and shoulder region 149*b*, referred herein to as the nose 149*d*, occurs at the axially outermost portion of composite blade profile 148 (relative to bit axis 105) where a tangent line to the blade profile 148 has a slope of zero. Moving radially outward, adjacent shoulder region 149*b* is the gage region 149*c*, which extends substantially parallel to bit axis 105 at the outer radial periphery of composite blade profile 148. As shown in composite blade profile 148, gage pads 147 define the gage region 149*c* and the outer radius $R_{110}$ of bit body 110. Outer radius $R_{110}$ extends to and therefore defines the full gage diameter of bit 100.

Referring briefly to FIG. 4, moving radially outward from bit axis 105, bit 100 and bit face 111 include cone region 149*a*, shoulder region 149*b*, and gage region 149*c* as previously described. Primary blades 141 extend radially along bit face 111 from within cone region 149*a* proximal bit axis 105 toward gage region 149*c* and outer radius $R_{110}$. Secondary blades 142 extend radially along bit face 111 from proximal nose 149*d* toward gage region 149*c* and outer radius $R_{110}$. Thus, in this embodiment, each primary blade 141 and each secondary blade 142 extends substantially to gage region 149*c* and outer radius $R_{110}$. In this embodiment, secondary blades 142 do not extend into cone region 149*a*, and thus, secondary blades 142 occupy no space on bit face 111 within cone region 149*a*. Although a specific embodiment of bit body 110 has been shown in described, one skilled in the art will appreciate that numerous variations in the size, orientation, and locations of the blades (for example, primary blades 141, secondary blades, 142, etc.), and cutter elements (for example, cutter elements 200) are possible.

Bit 100 includes an internal plenum extending axially from uphole end 100*a* through pin 120 and shank 130 into bit body 110. The plenum allows drilling fluid to flow from the drill string into bit 100. Body 110 is also provided with a plurality of flow passages extending from the plenum to downhole end 100*b*. As best shown in FIGS. 2-4, a nozzle 108 is seated in the lower end of each flow passage. Together, the plenum, passages, and nozzles 108 serve to distribute drilling fluid around cutting structure 140 to flush away formation cuttings and to remove heat from cutting structure 140, and more particularly cutter elements 200, during drilling.

Referring again to FIGS. 2-4, on each blade 141, 142, cutter elements 200 are arranged side-by-side in a row along the corresponding cutter supporting surface 144. Thus, in this embodiment, cutter elements 200 are positioned radially adjacent one another on a given blade 141, 142. However, in other embodiments, the cutter elements (for example, cutter elements 200) may be arranged in rows with one or more cutter element having a different geometries on the same blade (for example, blade 141, 142).

Referring now to FIGS. 6A-6D, one cutter element 200 is shown. Although only one cutter element 200 is shown in FIGS. 6A-6D, it is to be understood that all cutter elements 200 of bit 100 are the same. In general, bit 100 may include any number of cutter elements 200, and further, cutter elements 200 can be used in connection with different cutter elements (for example, cutter elements having geometries different than cutter element 200) on the same bit (for example, bit 100).

As previously described, cutter element 200 includes base or substrate 210 and cutting disc or layer 220 bonded to the substrate 210. Cutting layer 220 and substrate 210 meet at a reference plane of intersection 219 that defines the location at which substrate 210 and cutting layer 220 are fixably attached. In this embodiment, substrate 210 is made of tungsten carbide and cutting layer 220 is made of an ultrahard material such as polycrystalline diamond (PCD) or other superabrasive material. Part or all of the diamond in cutting layer 220 may be leached, finished, polished, or otherwise treated to enhance durability, efficiency or effectiveness. While cutting layer 220 is shown as a single layer of material mounted to substrate 210, in general, the cutting layer (for example, layer 220) may be formed of one or more layers of one or more materials. In addition, although substrate 210 is shown as a single, homogenous material, in general, the substrate (for example, substrate 210) may be formed of one or more layers of one or more materials.

Substrate 210 has central axis 215 as previously described and which generally defines the central axis of cutter element 200. In addition, substrate 210 has a first end 210*a* bonded to cutting layer 220 at plane of intersection 219, a second end 210*b* opposite end 210*a* and distal cutting layer 220, and a radially outer surface 212 extending axially between ends 210*a*, 210*b*. In this embodiment, substrate 210 is generally cylindrical, and thus, outer surface 212 is a cylindrical surface.

Figure 6A:
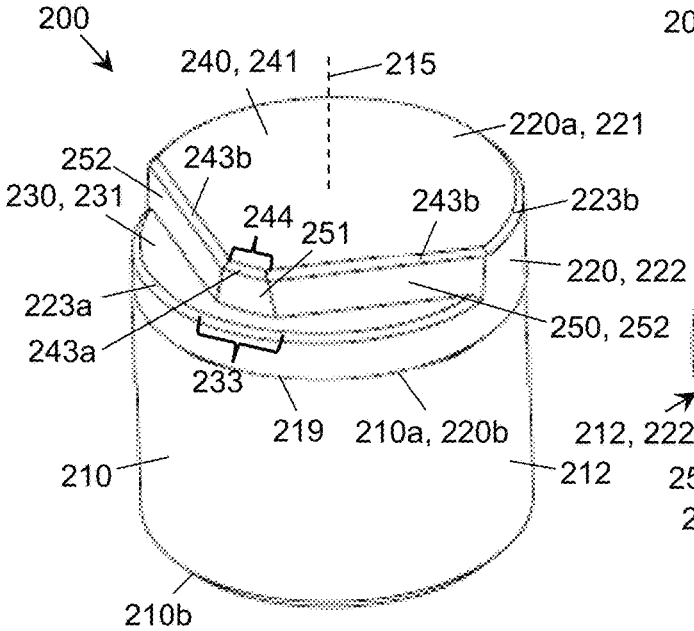
FIGS. 6A-6D are perspective, top, front, and side views, respectively, of one of the cutter elements of the drill bit of FIG. 1.
Figure 6B:
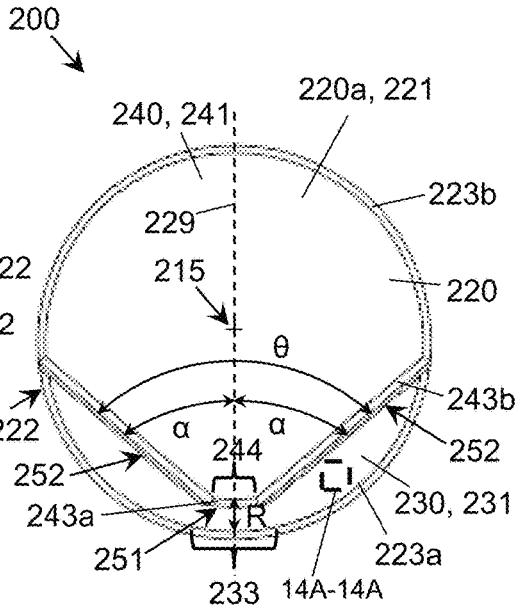
Figure 6C:
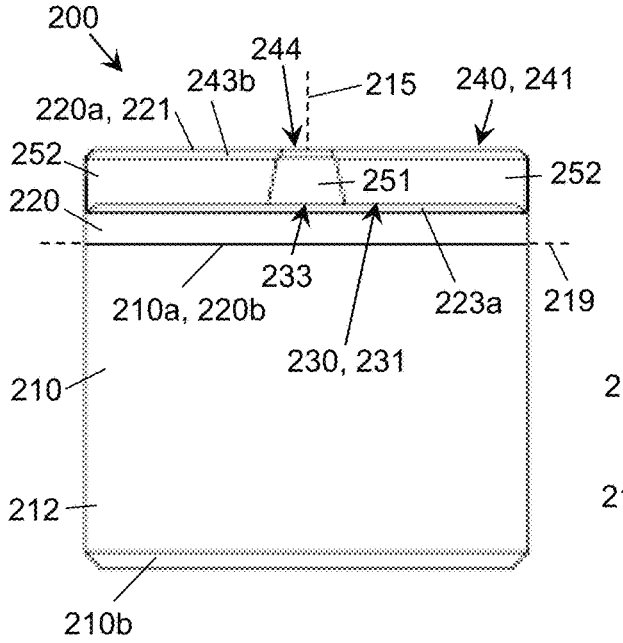
Figure 6D:
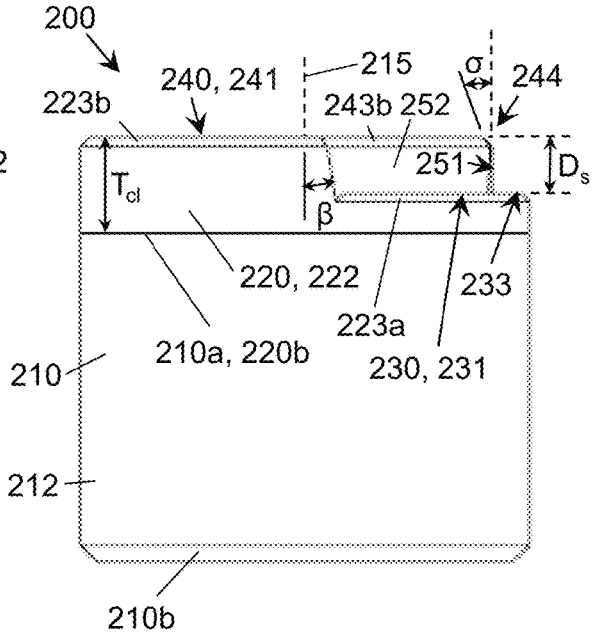

Referring still to FIGS. 6A-6D, cutting layer 220 has a first end 220*a* distal substrate 210, a second end 220*b* bonded to end 210*a* of substrate 210 at plane of intersection 219, and a radially outer surface 222 extending axially between ends 220*a*, 220*b*. In addition, as best shown in FIG. 6D, cutting layer 220 has an axial thickness $T_{cl}$ measured axially relative to central axis 215 between ends 220*a*, 220*b* in side view. For purposes of clarity, in embodiments disclosed herein where the axial thickness $T_{cl}$ of the cutting layer varies depending on the location along the cutting layer where it is measured, the axial thickness $T_{cl}$ is the maximum distance measured axially between the ends of the cutting layer (for example, ends 220*a*, 220*b* of cutting layer 220). For most applications, the axial thickness $T_{cl}$ of cutting layer 220 ranges from 2.0 mm to 8.0 mm, and alternatively ranges from 4.0 mm to 6.0 mm. In this embodiment, cutting layer 220 is generally disc-shaped, and thus, outer surface 222 is generally cylindrical. Outer surfaces 212, 222 of substrate 210 and cutting layer 222, respectively, are coextensive and contiguous such that there is a generally smooth transition moving axially between outer surfaces 212, 222.

The outer surface of cutting layer 220 at first end 220*a* defines cutting face 221 of cutter element 200, which is designed and shaped to engage and shear the formation during drilling operations. In this embodiment, a chamfer or bevel 223*a*, 223*b* is provided at each intersection of cutting face 221 and radially outer surface 222.

In this embodiment, cutter element 200 and cutting face 221 are symmetric about a reference plane 229 that contains central axis 215 and bisects cutter element 200. In addition, in this embodiment, cutting face 221 has a stepped geometry that defines a plurality of cutting edges and cutting surfaces designed to engage and shear the formation at different times during drilling operations. In particular, cutting face 221 includes a first or lower step 230, a second or upper step 240 that is axially spaced from first step 230 relative to central axis 215, and a riser 250 extending from first step 230 to second step 240. Second step 240 defines the portion of cutting face 221 that is axially distal substrate 210 and plane of intersection 219 as compared to first step 230; whereas first step 230 defines the portion of cutting face 221 that is axially proximal substrate 210 and plane of intersection 219 as compared to second step 240. Thus, first step 230 is axially positioned between second step 240 and substrate 210. Riser 250 extends from first step 230 to second step 240, and thus, riser 250 is axially positioned between steps 230, 240. As will be described in more detail below, cutter element 200 is sized, and positioned and oriented on the drill bit 100 such that first step 230 contacts and engages the formation during drilling before second step 240. Accordingly, first step 230 may also be referred to herein as primary cutting surface 230 and second step 240 may also be referred to herein as secondary cutting surface 240, with the understanding primary cutting surface 230 and secondary cutting surface 240 are portions or subcomponents of the overall cutting face 221 of cutter element 200.

Referring still to FIGS. 6A-6D, first step 230 extends radially and laterally from outer surface 222 and corresponding bevel 223*a* to riser 250, and second step 240 extends radially and laterally from outer surface 222 and corresponding bevel 223*b* to riser 250. Primary cutting surface 230 intersects bevel 223*a* along a radially outer, circumferentially extending edge. As will be described in more detail below, cutter element 200 is positioned and oriented on the drill bit 100 such that the portion of the edge at the intersection between primary cutting surface 230 and bevel 223*a* that is circumferentially centered on reference plane 229 in the top view of FIG. 6B contacts and engages the formation during drilling, and thus, defines a cutting tip 233 of primary cutting surface 230.

In this embodiment, each step 230, 240 is completely planar. In particular, first step 230 is defined by a first planar surface 231 that extends from outer surface 222 and the corresponding bevel 223*a* to riser 250, and second step 240 is defined by a second planar surface 241 that extends from outer surface 222 and the corresponding bevel 223*b* to riser 250. In this embodiment, each planar surface 231, 241 is disposed in a corresponding plane oriented perpendicular to central axis 215. Thus, planar surfaces 231, 241 are oriented parallel to each other and axially spaced apart. As best shown in FIG. 6D, planar surfaces 231, 241 defining steps 230, 240, respectively, are spaced apart an axial distance $D_s$ measured axially relative to central axis 215 between planar surfaces 231, 241 in side view. Thus, steps 230, 240 and corresponding planar surfaces 231, 241 may be described as being axially offset by the axial distance $D_s$. In embodiments described herein, the axial distance $D_s$ between steps 230, 240 and corresponding planar surfaces 231, 241 is at least 10% of the axial thickness $T_{cl}$ of cutting layer 220. As will be described in more detail below, in other embodiments, the first step (for example, first step 230), the second step (for example, second step 240), or both may be defined by one or more planar surfaces, one or more curved surfaces (for example, concave surfaces, convex surfaces, or both), or combinations thereof.

Referring again to FIGS. 6A-6D, in this embodiment, riser 250 has a V-shaped geometry and is symmetric about reference plane 229. More specifically, riser 250 includes a central surface 251 and a pair of lateral surfaces 252 extending linearly from central surface 251 to radially outer surface 222. Central surface 251 is spaced from and does not intersect radially outer surface 222, is positioned between lateral surfaces 252, and is bisected by reference plane 229 as shown in the top view of FIG. 6B. In this embodiment, central surface 251 and lateral surfaces 252 are planar surfaces. It should be appreciated that due to the V-shaped geometry of riser 250, second step 240 also has a V-shaped geometry.

A bevel or chamfer 243*a* is provided along the intersection of central surface 251 of riser 250 and secondary cutting surface 240, and a bevel or chamfer 243*b* is provided along the intersection of each lateral surface 252 and secondary cutting surface 240. Thus, central surface 251 of riser 250 extends laterally relative to reference plane 229 between lateral surfaces 252 and extends axially from primary cutting surface 230 to bevel 243*a*; and each lateral surface 252 of riser 250 extends laterally relative to reference plane 229 from central surface 251 to radially outer surface 222 and extends axially from primary cutting surface 230 to the corresponding bevel 243*b*. The intersections of surfaces 251, 252 with primary cutting surface 230 may be radiused to reduce stress concentrations at those locations.

Central surface 251, corresponding bevel 243*a*, and cutting tip 233 of primary cutting surface 230 are generally centered on reference plane 229 as shown in the top view of FIG. 6B. Accordingly, central surface 251, corresponding bevel 243*a*, and cutting tip 233 of primary cutting surface 230 are radially aligned relative to central axis 215. As noted above and described in more detail below, cutting tip 233 of primary cutting surface 230 contacts and engages the formation during drilling. As bevel 243*a* is radially aligned with cutting tip 233, the intersection between secondary cutting surface 230 and bevel 243*a* contacts and engages the formation during drilling, and thus, defines a cutting tip 244 of secondary cutting surface 240.

Referring now to the top view of FIG. 6B, cutting tip 233 is associated with primary cutting face 230 and cutting tip 244 is associated with secondary cutting face 240. Accordingly, cutting tip 233 may also be referred to herein as primary cutting tip 233 and cutting tip 244 may be referred to herein as secondary cutting tip 244. The portion of bevel 223*a* extending along primary cutting tip 233 has a width and bevel 243*a* extending along secondary cutting tip 244 has a width. In embodiments, described herein, the width of the bevel extending along the primary cutting tip (e.g., the width of the portion of bevel 223*a* extending along primary cutting tip 233) and the width of the bevel extending along the secondary cutting tip (e.g., the width of bevel 243*a* extending along secondary cutting tip 244) can be the same or different. Still further, in embodiments described herein, the width of the bevel extending along the primary cutting tip and/or the width of the bevel extending along the secondary cutting tip may be variable along its length or comprise a double bevel.

As best shown in FIG. 6B, cutting tip 244 is radially offset from cutting tip 233. In particular, cutting tips 233, 244 are radially spaced apart a radial offset distance R measured radially inward from cutting tip 233 to cutting tip 244 in top view. In embodiments described herein, the radial offset distance R ranges from 0.45 mm to 2.0 mm, and alternatively ranges from 0.5 mm to 1.25 mm.

Referring now to FIGS. 6B and 6C, central surface 251 is generally oriented perpendicular to reference plane 229 in top view, each lateral surface 252 and corresponding bevel 243*a*, 243*b* is angularly spaced from reference plane 229 by an acute angle $\alpha$ in top view; and lateral surfaces 252 and bevels 243*a*, 243*b* are angularly spaced from each other by an angle $\theta$ in top view. In embodiments described herein, each angle $\alpha$ is an acute angle ranging from 35° to 70°, and alternatively ranging from 45° to 50°; and angle $\theta$ ranges from 70° to 140°, and alternatively ranges from 90° to 100°. In this embodiment, each angle $\alpha$ is the same, and in particular, is 50°, and thus, angle $\theta$ is 100°. In other embodiments, angles $\alpha$ may not be the same.

Referring now to FIG. 6D, central surface 251 and lateral surfaces 252 are planar surfaces that can be oriented perpendicular to or at acute angles relative to central axis 215 in side view. More specifically, central surface 251 is oriented at an angle $\sigma$ measured relative to central axis 215, and each lateral surface 252 is oriented at an angle $\beta$ relative to central axis 215. In embodiments described herein, angle $\sigma$ of central surface 251 ranges from −20° to +20°, and alternatively ranges from −5° to +10°; and angle $\beta$ of each lateral surface 252 ranges from −15° to +25°, and alternatively ranges from 0° to +15°. It should be appreciated that central surface 251 can be oriented parallel to central axis 215, in which case angle $\sigma$ is zero; and each lateral surface 252 can be oriented parallel to central axis 215, in which case angle $\beta$ of that corresponding lateral surface 252 is zero. Still further, it should be appreciated that each angle $\sigma$, $\beta$ can be positive or negative. In general, angle $\beta$ of each lateral surface 252 can be the same or different. For purposes clarity, angle $\sigma$, $\beta$ is positive when surface 251, 252, respectively, slopes radially inward toward central axis 215 moving axially upward from primary cutting surface 230 to secondary cutting surface 240; and angle $\sigma$, $\beta$ is negative when surface 251, 252, respectively, slopes radially outward away central axis 215 moving axially upward from primary cutting surface 230 to secondary cutting surface 240. In this embodiment, central surface 251 is oriented parallel to central axis 215, and thus, angle $\sigma$ is 0°; and angle $\beta$ of each lateral surface 252 is the same, and in particular, is +6°.

Referring again to FIGS. 2-4, cutting elements 200 are mounted to bit body 110 such that cutting faces 221 are exposed to the formation material, and further, such that cutting faces 221 are oriented so that cutting tips 233, 244, primary cutting surface 230, and secondary cutting surface 240 are positioned to perform their functional roles in shearing, excavating, and removing rock from beneath the drill bit 100 during rotary drilling operations. More specifically, each cutter element 200 is mounted to a corresponding blade 141, 142 with substrate 210 received and secured in a pocket formed in the cutter support surface 144 of the blade 141, 142 to which it is fixed by brazing or other suitable means. In addition, each cutter element 200 is oriented such that the corresponding cutting face 221 is exposed and leads the cutter element 200 relative to cutting direction 106 of bit 100. As previously described, cutting faces 221 are forward-facing.

Figure 7:
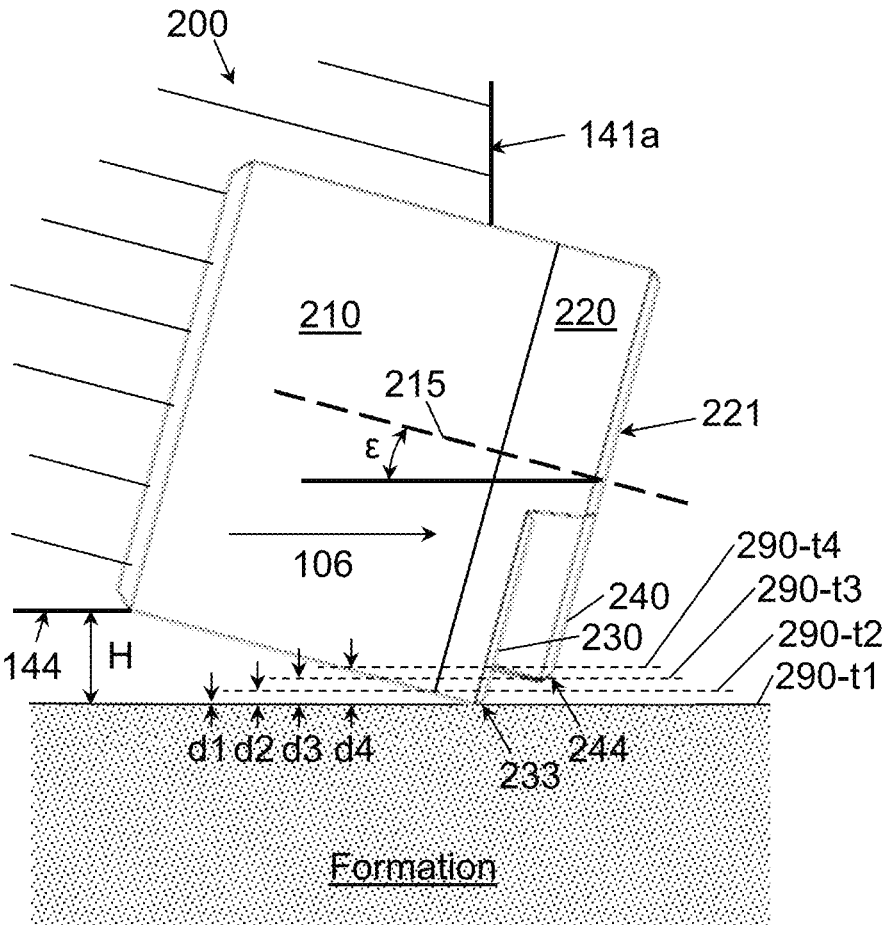
FIG. 7 is an enlarged partial cross-sectional side view of one of the cutter elements of FIG. 1 engaging the formation during drilling and schematically illustrating a plurality of wear planes at sequential times during drilling.

Referring briefly to FIG. 7, a cross-sectional side view of one exemplary cutter elements 200 taken in a plane oriented perpendicular to cutter supporting surface 144 and containing axis 215 is shown. As shown in FIG. 7, each cutter element 200 is oriented with cutting tip 233 distal the corresponding cutter support surface 144 to define an extension height H of the corresponding cutter element 200. As used herein and generally known in the art, the phrase "extension height" refers to the maximum distance or height to which a structure (for example, cutting face 221) extends measured perpendicularly from the cutter-supporting surface of the blade to which it is mounted. Thus, cutting tip 233 of each cutter element 200 defines the point on the corresponding cutting face 221 that is furthest from the cutter supporting surface 144 of the corresponding blade 141, 142 as measured perpendicular to the corresponding cutter supporting surface 144. The extension heights H of cutter elements 200 are selected to so as to ensure that cutting edges 233 of cutter elements 200 achieve the desired depth of cut, or at least be in contact with the rock during drilling. In embodiments described herein, the extension height H of cutter elements 200 range from 0.75 mm to 2.75 mm, and alternatively range from 1.25 mm to 2.25 mm.

Referring again to FIGS. 2-4, each cutting tip 233 also defines the radial position of the corresponding cutter element 200. As used herein, the term "radial position" of a cutter element or a cutting face is defined by the radial distance measured perpendicularly from the bit axis to the cutting edge of the cutting face that defines the extension height of the cutter element. Thus, each cutter element 200 and corresponding cutting face 221 has a radial position defined by the radial distance measured perpendicularly from the bit axis 105 to the corresponding cutting tip 233. In this embodiment, each cutter element 200 on drill bit 100 has a unique radial position, and thus, each cutting tip 233 is disposed at a unique and different radial distance measured perpendicularly from the bit axis 105 to the cutting tip 233. In this embodiment, cutter elements 200 are disposed along the cone region 149*a*, at the nose 149*d*, and along the shoulder region 149*b*.

Referring again to FIG. 7, although each cutter element 200 is disposed at a different radial position relative to central axis 105 of bit 100, each cutter element 200 is mounted to the corresponding blade 141, 142 in a similar orientation relative to the corresponding cutter-supporting surface 144 and formation being drilled. Accordingly, the mounting orientation of one cutter element 200 is shown in FIG. 7 with the understanding that each cutter element 200 is mounted to the corresponding blade 141, 142 in a similar manner.

Cutter element 200 is mounted with central axis 215 oriented at an acute angle c measured between axis 215 and cutter-supporting surface 244. It should be appreciated that during drilling operations, cutter-supporting surface 144 is parallel to the surface of the formation being cut by cutter element 200, and thus, central axis 215 is also oriented at acute angle c relative to the surface of the formation being cut by cutter element 200. Angle c may also be commonly known as a "rake angle," or more specifically, a "backrake angle" as cutter element 200 is tilted backward such that primary cutting surface 230 and secondary cutting surface 240 generally slope rearwardly relative to the cutting direction 106 moving radially outward along cutting face 221 toward cutting tip 233. In embodiments described herein, each cutter element (for example, each cutter element 200) is oriented at an acute backrake angle c ranging from 0° to 45°, and alternatively ranging from 10° to 30°. In general, the backrake angle c of any two or more cutter elements can be the same or different. In this embodiment, each backrake angle c is the same, and in particular, is 20°.

Cutter elements 200 are sized, positioned, and oriented such that cutting tips 233, 244 and proximal portions of primary cutting surface 230 and secondary cutting surface 240 engage and shear the formation during drilling operations. More specifically, cutter elements 200 are sized, positioned, and oriented such that cutting tips 233 and proximal portions of primary cutting faces 230 engage and shear the formation during the initial phases of drilling operations, but after sufficient wear of cutting tips 233 and primary cutting faces 230, cutting tips 244 and proximal portions of secondary cutting faces 240 come into contact with the formation, and begin to engage and shear the formation. For example, in FIG. 7, one exemplary cutter element 200 is shown during the initial stages of drilling prior to substantial wear. As shown in FIG. 7, cutter element 200 is mounted to the corresponding cutter supporting surface 144 such that cutting tip 233 contacts the formation, however, cutting tip 244 is spaced from the formation, and thus, does not contact the formation. As drilling progresses, cutting tip 233 and the portions of primary cutting surface 230 radially adjacent cutting tip 233 will abrasively wear until cutting tip 244 and radially adjacent portions of secondary cutting surface 240 come into contact with the formation. For purposes of clarity and further explanation, a plurality of wear planes 290-*d*1, 290-*d*2, 290-*d*3, 290-*d*4 that schematically illustrate increasing depths d1, d2, d3, d4, respectively, of abrasive wear of cutter element 200 at different times during drilling operations are shown. It should be appreciated that wear planes 290-*d*1, 290-*d*2, 290-*d*3, 290-*d*4 are coincident with the surface of the formation being cut by cutter element 200 at successive wear depths d1, d2, d3, d4, respectively. Wear depth d1 is representative of little to no wear of cutter element 200 (for example, during early stages of drilling); wear depth d2 is representative of small amount of wear of cutter element 200 (for example, during stages of drilling when cutting tip 233 and primary cutting surface 230 have experienced wear but cutting tip 244 has not yet come into contact with the formation); wear depth d3 is representative of moderate amount of wear of cutter element 200 (for example, during stages of drilling when cutting tip 233 and primary cutting surface 230 exhibit sufficient wear that cutting tip 244 and secondary cutting surface 240 come into contact with the formation); and wear depth d4 is representative of a substantial amount of wear of cutter element 200 (for example, during stages of drilling when cutting tip 244 and secondary cutting surface 240 exhibit wear). As shown by wear planes 290-*d*1, 290-*d*2, during early stages of drilling and after some wear of cutting tip 233 and primary cutting surface 230, cutting tip 244 and secondary cutting face 244 remain spaced from the formation. Consequently, during early stages of drilling, cutting tip 244 and secondary cutting face 244 experience little to no abrasive wear, and thus, remain fresh and unworn. As shown by wear plane 290-*d*3, after cutting tip 233 and primary cutting surface 230 experience a sufficient wear depth d3, cutting tip 244 and secondary cutting surface 240 come into contact with the formation. Thus, during drilling operations, cutting tip 244 and secondary cutting surface 240 engage the formation at a later, different time than cutting tip 233 and primary cutting surface 230, thereby presenting "fresh" and unworn cutting edges and surfaces to the formation.

It should be appreciated that wear depth d3, the contact surface area of cutting tip 244 and secondary cutting surface 240 that engage the formation (i) is much smaller than the contact surface area of cutting tip 233 and primary cutting surface 230 that engage the formation, (ii) leads the contact surface area of cutting tip 233 and primary cutting surface 230, and (iii) is spaced apart from the contact surface area of cutting tip 233 and primary cutting surface 230. Due to the smaller contact surface area between cutting tip 244 and secondary cutting surface 240 and the formation, and the V-shaped geometry of riser 250 and secondary cutting surface 240, cutting tip 244 and secondary cutting surface 240 present a more aggressive geometry to the formation as compared to cutting tip 233 and primary cutting surface 230, and further, and offer the potential to increase point loading of the formation (smaller contact surface area) for enhanced cutting efficiency and reduced weight-on-bit (WOB) demands to maintain or achieve a desired depth-of-cut (DOC). In addition, due to the radial alignment of cutting tip 244 with cutting tip 233, as well as the radial alignment of cutting faces 230, 240, the more aggressive cutting tip 244 and secondary cutting surface 240 offer the potential to generate cracks in the formation immediately in advance of the trailing, worn cutting tip 233 and primary cutting surface 230, thereby offering the potential to improve cutting efficiency and overall durability of cutter element 200.

Figures 8A, 8B:
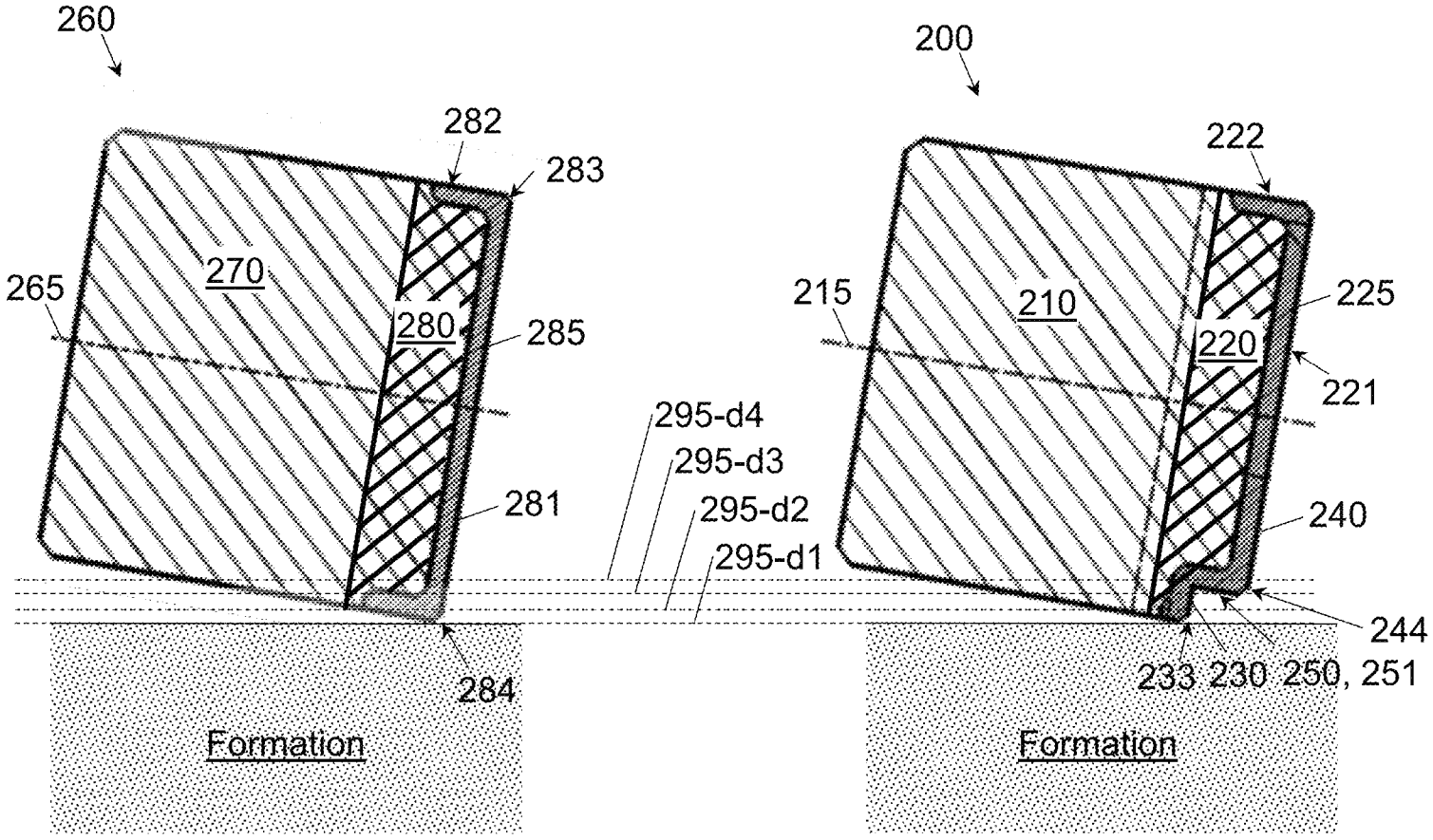
FIGS. 8A and 8B are enlarged cross-sectional views of a conventional cutter element and a similar sized cutter element of FIGS. 6A-6D, respectively, engaging the formation during drilling and schematically illustrating a plurality of wear planes at different depths of abrasive wear during drilling.

Referring now to FIGS. 8A and 8B, other potential benefits resulting from the geometry of stepped cutting face 221 will now be described. In FIG. 8A, a cross-sectional view of a conventional cutter element 260 during initial stages of drilling a subterranean formation is shown, and in FIG. 8B, a cross-sectional view of cutter element 200 during initial stages of drilling a subterranean formation is shown. As shown in FIG. 8A, conventional cutter element 260 includes an elongated and generally cylindrical support member or substrate 270 and a cylindrical hard cutting layer 280 of polycrystalline diamond bonded to the exposed, leading end of the support member 260. The support member 260 has a central axis 265. Cutting layer 280 has a circular, planar cutting face 281 oriented perpendicular to central axis 265 and a radially outer cylindrical surface 282 that intersects cutting face 281 along an annular edge 283 (cylindrical surface 282 intersects cutting face 281 along the entire outer circumference of cutting face 281). In this embodiment, the annular edge 283 comprises a bevel or chamfer. The portion of annular edge 283 that at the extension height of cutter element 260 when mounted to a drill bit defines a cutting tip 284 of cutter element 265. In FIGS. 8A and 8B, each cutting layer 220, 280 has been leached using techniques known in the art, thereby defining leached portions 225, 285, respectively, extending from the outer surfaces of cutting faces 221, 281.

In FIGS. 8A and 8B, cutter elements 200, 260 are similarly sized and oriented at the same backrake angles E. In addition, each cutting layer 220, 280 is leached to a similar depth measured perpendicularly from the outer surfaces thereof. As is known in the art, the leached portion of a polycrystalline diamond cutting layer (for example, leached portions 225, 285 of cutting layers 220, 280) provide increased hardness and abrasion resistance as compared to unleached portions of the polycrystalline diamond cutting layer. Accordingly, it is also generally known in the art that the greater the volume of the leached portion of a polycrystalline diamond cutting layer available for engaging the formation during drilling, the better the durability of the corresponding cutter element. Due to the stepped geometry of cutting face 221 as compared to the conventional planar cutting face 281, the volume of leached portion 225 of cutting layer 220 available for engaging the formation during drilling is greater than the volume of leached portion 285 of conventional cutting layer 280 available for engaging the formation during drilling for similarly sized cutter elements 200, 260 with similar leached depths of cutting layers 220, 280. Accordingly, cutter element 200 with stepped cutting face 221 offers the potential for enhanced durability as compared to conventional cutter element 260 with planar cutting face 281. For purposes of clarity and further explanation, wear planes 295-*d*1, 295-*d*2, 295-*d*3, 295-*d*4 disposed at wear depths d1, d2, d3, d4, respectively, as previously described are shown in FIGS. 8A and 8B. As shown in FIGS. 8A and 8B, at wear depth d1, leached portion 225 of cutting layer 220 engages the formation at cutting tip 233 and along primary cutting surface 230 while radially outer surface 222 is spaced from the formation, and leached portion 285 of cutting layer 280 engages the formation at cutting tip 284 and along cutting face 281 while radially outer surface 282 is spaced from the formation; at wear depth d2, leached portion 225 of cutting layer 220 engages the formation along primary cutting surface 230 and a very small unleached portion of cutting layer 220 along radially outer surface 222 contacts the formation, and leached portion 285 of cutting layer 280 engages the formation along cutting face 281 and a very small unleached portion of cutting layer 280 along radially outer surface 282 contacts the formation; at wear depth d3, leached portion 225 of cutting layer 220 engages the formation along primary cutting surface 230 and at cutting tip 244 while a very small unleached portion of cutting layer 220 along radially outer surface 222 contacts the formation, and leached portion 285 of cutting layer 280 engages the formation along cutting face 281 and a very small unleached portion of cutting layer 280 along radially outer surface 282 contacts the formation; and at depth d4, leached portion 225 of cutting layer 220 engages the formation along secondary cutting surface 230 and central surface 251 of riser 250 while a very small unleached portion of cutting layer 220 along radially outer surface 222 contacts the formation, and leached portion 285 of cutting layer 280 engages the formation along cutting face 281 and a large unleached portion of cutting layer 280 along radially outer surface 282 contacts the formation. Thus, at depths d1, d2, d3, the surface areas of leached portions 285, 225 of cutting layers 280, 220 of conventional cutter element 260 and cutter element 200, respectively, that contact the formation are similar. However, due to the presence of riser 250, at depth d4, the surface area of leached portion 225 of cutting layer 220 that contacts the formation is substantially greater than the surface area of leached portion 285 of cutting layer 280 of conventional cutter element 260 that contacts the formation.

Referring now to FIGS. 9A-9D, an embodiment of a cutter element 300 that can be used on drill bit 100 in place of one or more cutter elements 200 is shown. Cutter element 300 is similar to cutter element 200 previously described. For example, cutter element 300 is substantially the same as cutter element 200 previously described with the exception that a pair of planar flats are disposed along the cylindrical radially outer surfaces of the substrate and cutting layer, and the primary cutting surface is V-shaped due to the planar flats (instead of generally semi-cylindrically shaped). Accordingly, the differences between cutter elements 200, 300 will be described it being understood the other features are generally the same. In addition, for purposes of clarity, like features of cutter element 300 and previously described cutter elements (for example, cutter element 200) are given the same reference numerals.

In this embodiment, cutter element 300 includes a base or substrate 310 and a cutting layer 320 bonded to the substrate 310 at a reference plane of intersection 319. Substrate 310 is made of tungsten carbide and cutting layer 320 is made of an ultrahard material such as polycrystalline diamond (PCD) or other superabrasive material. Substrate 310 has central axis 315 that generally defines the central axis of cutter element 300. In addition, substrate 310 has a first end 310*a* bonded to cutting layer 320 at plane of intersection 319, a second end 310*b* opposite end 310*a* and distal cutting layer 320, and a radially outer surface 312 extending axially between ends 310*a*, 310*b*. Similar to substrate 210 previously described, in this embodiment, substrate 310 is generally cylindrical, and thus, outer surface 312 is a cylindrical surface.

Cutting layer 320 has a first end 320*a* distal substrate 310, a second end 320*b* bonded to end 310*a* of substrate 310 at plane of intersection 319, and a radially outer surface 322 extending axially between ends 320*a*, 320*b*. In addition, as best shown in FIG. 9D, cutting layer 320 has an axial thickness $T_{cl}$ as previously described measured axially relative to central axis 315 between ends 320*a*, 320*b* in side view. In this embodiment, cutting layer 320 is generally disc-shaped, and thus, outer surface 322 is generally cylindrical. Outer surfaces 312, 322 of substrate 310 and cutting layer 322, respectively, are coextensive and contiguous such that there is a generally smooth transition moving axially between outer surfaces 312, 322.

The outer surface of cutting layer 320 at first end 320*a* defines a cutting face 321 of cutter element 300, which is designed and shaped to engage and shear the formation during drilling operations. In this embodiment, a chamfer or bevel 323*a*, 323*b*, 323*c* is provided at each intersection of primary cutting face 321 and radially outer surface 322.

In this embodiment, cutter element 300 and cutting face 321 are symmetric about a reference plane 329 that contains central axis 315 and bisects cutter element 300. In addition, similar to cutting face 221 previously described, in this embodiment, cutting face 321 has a stepped geometry that defines a plurality of cutting edges and cutting surfaces designed to engage and shear the formation at different times during drilling operations. In particular, cutting face 321 includes a first or lower step 330, a second or upper step 240 that is axially spaced from first step 330 relative to central axis 315, and a riser 250 extending from first step 330 to second step 240. First step 330 is axially positioned between second step 240 and substrate 310. Riser 250 extends from first step 330 to second step 240, and thus, riser 250 is axially positioned between steps 330, 240. Riser 250 and second step 240 are each as previously described.

Cutter element 300 is sized, and positioned and oriented on a drill bit (for example, drill bit 100) in the same manner as cutter element 200 previously described such that first step 330 contacts and engages the formation during drilling before second step 240. Accordingly, first step 330 may also be referred to herein as primary cutting surface 330 and second step 240 may also be referred to herein as secondary cutting surface 240, with the understanding primary cutting surface 330 and secondary cutting surface 240 are portions or subcomponents of the overall cutting face 321 of cutter element 300.

In this embodiment, primary step 330 is completely planar. In particular, primary step 330 is defined by a first planar surface 331 that extends from bevels 323*a*, 323*b*, 323*c* to riser 250. Second step 240 is defined by second planar surface 241 as previously described, which extends from outer surface 322 and a corresponding bevel 223*b* to riser 250. In this embodiment, each planar surface 331, 241 is disposed in a corresponding plane oriented perpendicular to central axis 315. Thus, planar surfaces 331, 241 are oriented parallel to each other and axially spaced apart. As best shown in FIG. 9D, planar surfaces 331, 241 defining steps 330, 240, respectively, are spaced apart an axial distance $D_s$ measured axially relative to central axis 315 between planar surfaces 331, 241 in side view. Thus, steps 330, 240 and corresponding planar surfaces 231, 241 may be described as being axially offset by the axial distance $D_s$ as previously described Unlike cutter element 200 previously described, in this embodiment, cutter element 300 includes a pair of planar surfaces or flats 313*a*, 313*b* extending across outer surfaces 312, 322 of substrate 310 and cutting layer 320, respectively. Each flat 313*a*, 313*b* extends axially from a corresponding chamfer 323*a*, 323*b* and primary cutting surface 330 along outer surface 322 of cutting layer 320 and across plane of intersection 319 into and along outer surface 312 of substrate 310. However, in this embodiment, flats 313*a*, 313*b* do not extend to second end 310*b* of substrate 310. Rather, flats 313*a*, 313*b* terminate proximal but axially spaced from end 310*b*. Each flat 313*a*, 313*b* is contiguous and smooth as it extends across outer surfaces 312, 322. Flats 313*a*, 313*b* are circumferentially spaced along outer surfaces 312, 322, positioned on opposite circumferential sides of reference plane 329 and are symmetric relative to reference plane 329.

Referring still to FIGS. 9A-9D, first step 330 extends radially and laterally from outer surface 322, flats 313*a*, 313*b*, and corresponding bevels 323*a*, 323*b*, 323*c* to riser 250, and second step 240 extends radially and laterally from outer surface 322 and corresponding bevel 223*b* to riser 250. In addition, bevel 323*a* is positioned between primary cutting surface 330 and flat 313*a*, bevel 323*b* is positioned between primary cutting surface 330 and flat 313*b*, and bevel 323*c* is positioned between primary cutting surface 330 and the cylindrical outer surface 322. Still further, bevel 323*c* is circumferentially positioned between bevels 323*a*, 323*b* and is bisected by reference plane 329.

Primary cutting surface 330 intersects bevel 323*c* along a radially outer, circumferentially extending edge that defines a cutting tip 333 of primary cutting surface 330. Cutter element 300 is positioned and oriented on a drill bit (for example, drill bit 100) in the same manner as cutter element 200 such that cutting tip 333 contacts and engages the formation during drilling, and defines the extension height of cutter element 300 when mounted to the drill bit.

Figure 9A:
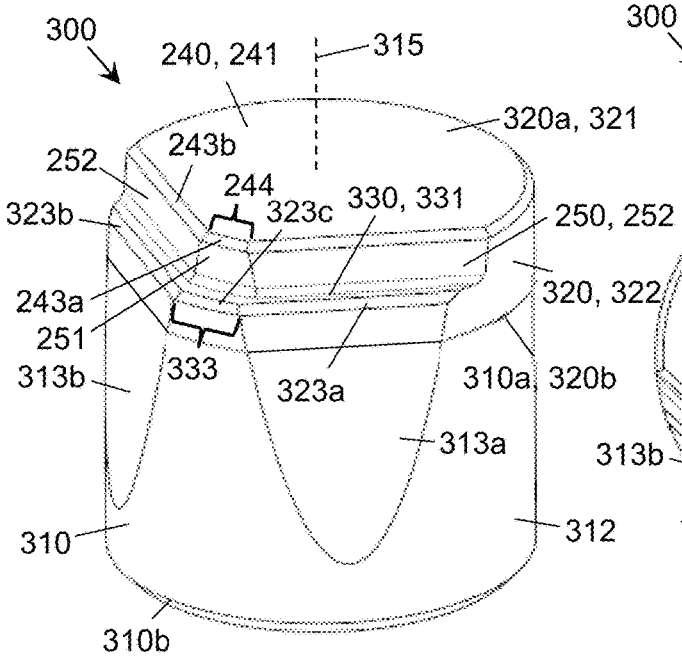
FIGS. 9A-9D are perspective, top, front, and side views, respectively, of an embodiment of a cutter element in accordance with principles described herein.
Figure 9B:
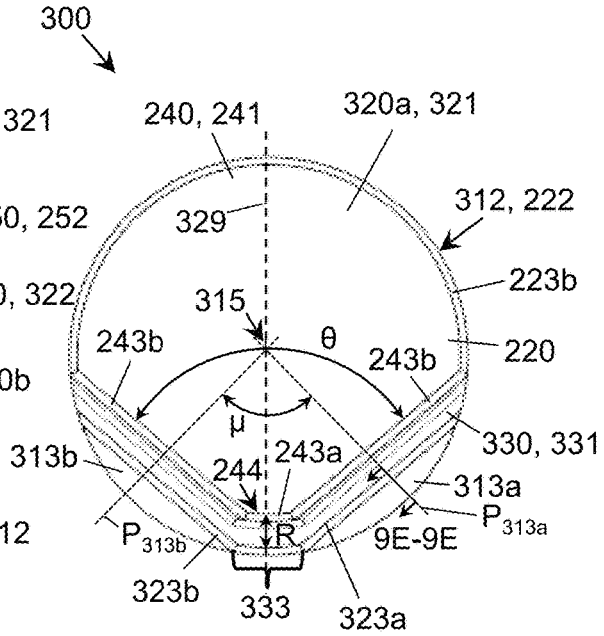
Figure 9C:
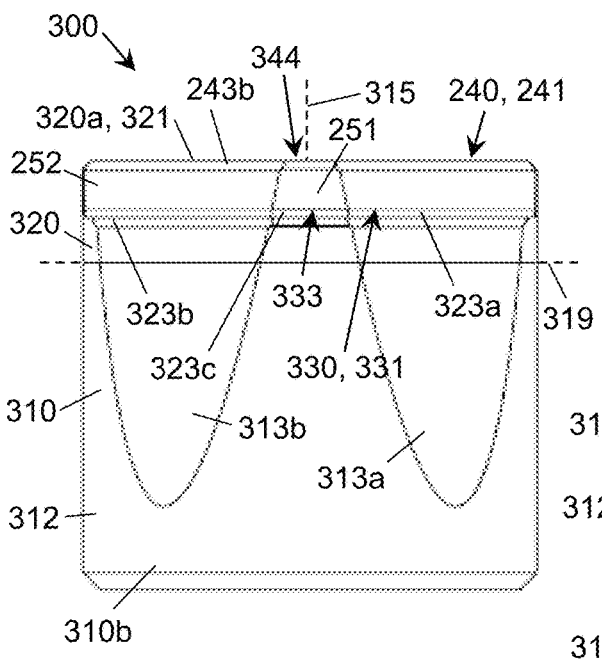
Figure 9D:
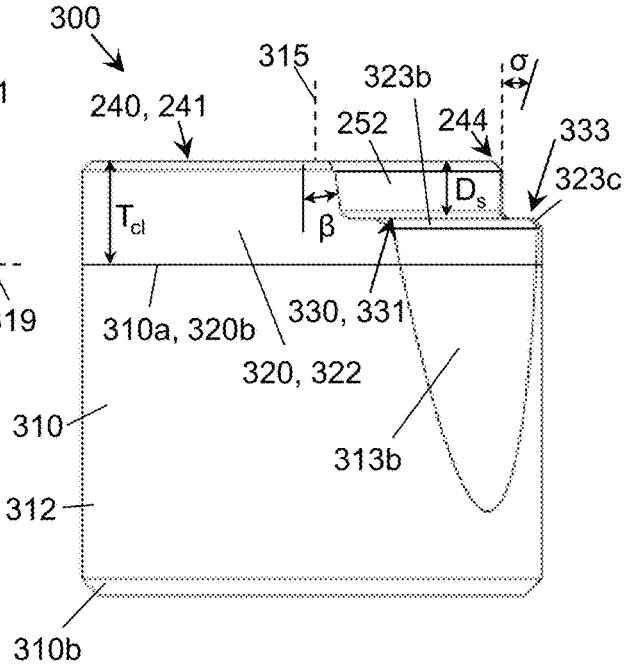

Bevel 243*a*, cutting tip 244, and cutting tip 333 are generally centered on reference plane 329 as shown in the top view of FIG. 9B. Accordingly, bevel 243*a*, cutting tip 333, and cutting tip 244 are radially aligned relative to central axis 315. As best shown in FIG. 9B, cutting tip 244 is radially offset from cutting tip 333. In particular, cutting tips 333, 244 are radially spaced apart a radial offset distance R as previously described measured radially inward from cutting tip 333 to cutting tip 244 in top view.

In this embodiment, each flat 313*a*, 313*b* is oriented perpendicular to a plane $P_{313a}$, $P_{313b}$, respectively, containing the central axis 315. Planes $P_{313a}$, $P_{313b}$ are angularly spaced apart about axis 315 by an angle μ. In embodiments described herein, angle μ is less than 180°, alternatively ranges from 70° to 120°, and alternatively ranges from 80° to 100°. Still further, angle μ, which is also the angle between bevels 323*a*, 323*b* in top view, can be the same or different than angle θ between lateral surfaces 252 and bevels 243*a*, 243*b* in top view. In this embodiment, angles θ, μ are the same, and in particular, are both 90°.

Figure 9E:
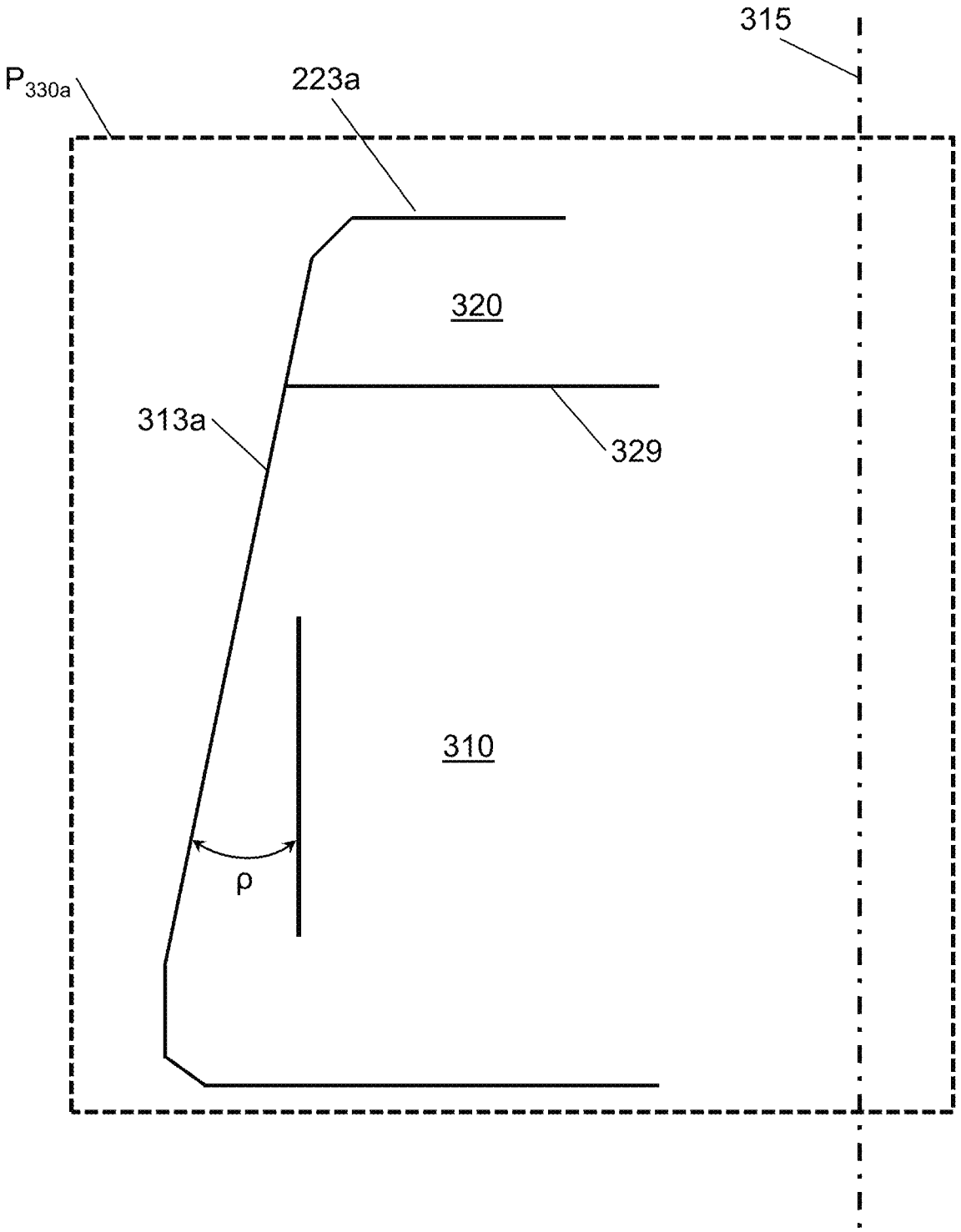
FIG. 9E is a partial cross-sectional view of the cutter element of FIGS. 9A-9D taken in section 9E-9E of FIG. 9B.

Each flat 313*a*, 313*b* generally slopes radially outward moving axially from its end at primary cutting surface 230 and bevel 323*a*, 323*b*, respectively, to its end along substrate 310. More specifically, FIG. 9E illustrates a partial cross-section of cutter element 300 taken in section 9E-9E of FIG. 9B. Section 9E-9E lies in reference plane $P_{313a}$, and thus, FIG. 9E illustrates a partial cross-section of cutter element 300 as viewed perpendicular to plane $P_{313a}$ and parallel to flat 313*a*. As shown in FIG. 9E, flat 313*a* is oriented at an acute angle ρ measured in plane $P_{313a}$ between central axis 315 and flat 313*a*. Angle ρ is preferably 2° to 10°, and more preferably 6° to 8°. In this embodiment, angle ρ is 7°. Although FIG. 9E illustrates the slope angle ρ of flat 313*a*, it should be appreciated that flat 313*b* is similarly configured and oriented. In general, both flats 313*a*, 313*b* can be oriented at the same angle ρ or different angles ρ. In this embodiment, both flats 313*a*, 213*b* are oriented at the same angle ρ of 7° measured in the corresponding plane $P_{313a}$, $P_{213b}$ relative to central axis 315. However, in other embodiments, the angle the angle ρ between each flat 313*a*, 313*b* relative to central axis 315 measured in plane $P_{313a}$, $P_{313b}$, respectively, may be different.

Cutter element 300 is mounted to a cutter supporting surface (for example, cutter supporting surface 144) of a blade (for example, blade 141, 142) of a drill bit (for example, drill bit 100) in the same manner as cutter element 200. For example, a plurality of cutter elements 300 can be positioned and oriented at the same backrake angle c as previously described, with cutting tips 333 defining the extension height (for example, extension height H) of the cutter elements 300, and with cutting tips 333 designed to contact and engage the formation before cutting tips 244. In addition, cutter element 300 functions in substantially the same manner as cutter element 200, and thus, offers the potential for the same benefits and advantages during drilling operations. It should be appreciated that due to the presence of flats 313*a*, 313*b*, primary cutting surface 330 has a V-shaped geometry, which presents a more aggressive profile as compared to the more semi-circular primary cutting surface 230 of cutter element 200, which offers the potential for increased cutting efficiency. Flats 313*a*, 313*b* also offer the potential for enhanced drill bit stability during drilling operations due to a higher depth-of-cut and the tendency of the V-shape geometry to resist lateral movements and vibrations.

In the embodiments of cutter elements 200, 300 previously described, primary cutting faces 230, 330 and secondary cutting faces 240 are completely defined by planar surfaces 231, 331, 241, respectively, and further, planar surfaces 231, 331, 241 are disposed in parallel planes oriented perpendicular to the corresponding central axis 215, 315. However, in other embodiments, the primary cutting face (for example, cutting surface 230, 330), the secondary cutting face (for example, cutting surface 240), or both may be defined by a plurality of planar facets, one or more curved surfaces (for example, concave surface(s), convex surface(s), or both), or combinations thereof.

Referring now to FIGS. 10A-10D, an embodiment of a cutter element 400 that can be used on drill bit 100 in place of one or more cutter elements 200 is shown. Cutter element 400 is similar to cutter elements 200, 300 previously described. For example, cutter element 400 is substantially the same as cutter element 200 previously described with the exception that the secondary cutting face comprises a plurality of planar facets (instead of being defined by a single planar surface) and the riser is generally semi-cylindrical (instead of being V-shaped). Accordingly, the differences between cutter elements 200, 400 will be described it being understood the other features are generally the same. In addition, for purposes of clarity, like features of cutter element 400 and previously described cutter elements (for example, cutter elements 200, 300) are given the same reference numerals.

In this embodiment, cutter element 400 includes a base or substrate 210 and a cutting layer 420 bonded to the substrate 410 at a reference plane of intersection 419. Substrate 210 is as previously described. Cutting layer 420 is made of an ultrahard material such as polycrystalline diamond (PCD) or other superabrasive material. First end 210*a* of substrate 210 is bonded to cutting layer 420 at plane of intersection 419. The radially outer surface 212 of substrate 210 is a cylindrical surface.

Figure 10A:
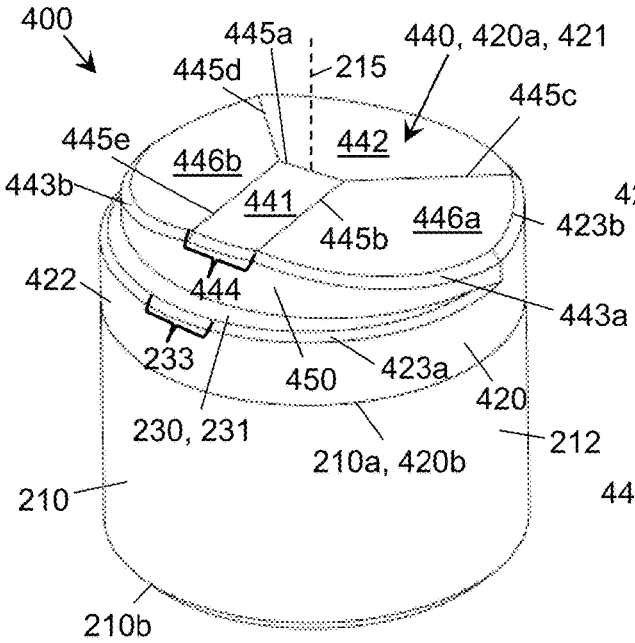
FIGS. 10A-10D are perspective, top, front, and side views, respectively, of an embodiment of a cutter element in accordance with principles described herein.
Figure 10B:
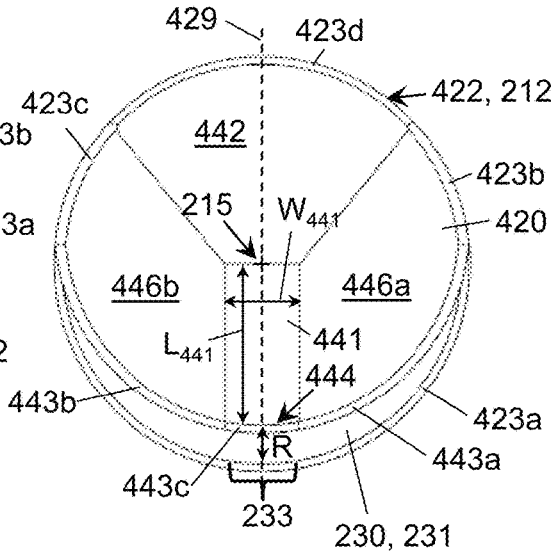
Figure 10C:
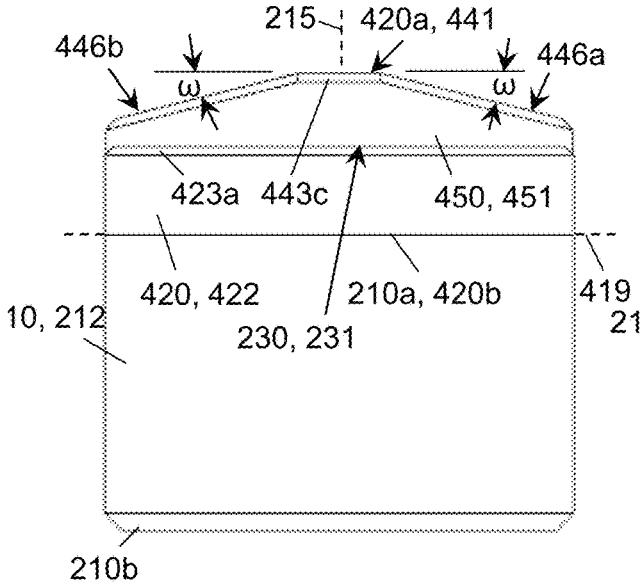
Figure 10D:
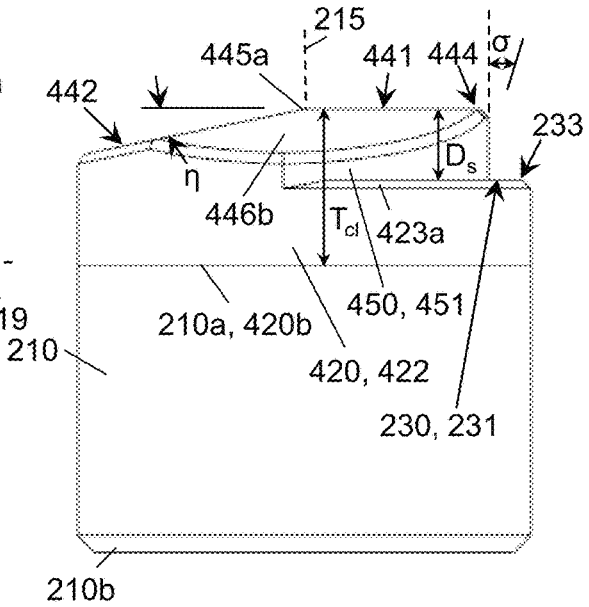

Cutting layer 420 has a first end 420*a* distal substrate 210, a second end 420*b* bonded to end 410*a* of substrate 210 at plane of intersection 419, and a radially outer surface 422 extending axially between ends 420*a*, 420*b*. In addition, as best shown in FIG. 10D, cutting layer 420 has an axial thickness $T_{cl}$ as previously described measured axially relative to central axis 215 between ends 420*a*, 420*b* in side view. In this embodiment, cutting layer 420 is generally disc-shaped, and thus, outer surface 422 is generally cylindrical. Outer surfaces 212, 422 of substrate 210 and cutting layer 422, respectively, are coextensive and contiguous such that there is a generally smooth transition moving axially between outer surfaces 212, 422.

The outer surface of cutting layer 420 at first end 420*a* defines a cutting face 421 of cutter element 400, which is designed and shaped to engage and shear the formation during drilling operations. In this embodiment, a plurality of chamfers or bevels 423*a*, 423*b*, 423*c*, 423*d*, are provided at the intersections of cutting face 421 and radially outer surface 422.

In this embodiment, cutter element 400 and cutting face 421 are symmetric about a reference plane 429 that contains central axis 215 and bisects cutter element 400. In addition, similar to cutting faces 221, 321 previously described, cutting face 421 has a stepped geometry that defines a plurality of cutting edges and cutting surfaces designed to engage and shear the formation at different times during drilling operations. In particular, cutting face 421 includes a first or lower step 230 as previously described, a second or upper step 440 that is axially spaced from first step 230 relative to central axis 215, and a riser 450 extending from first step 230 to second step 440. Second step 440 defines the portion of cutting face 421 that is axially distal substrate 210 and plane of intersection 419 as compared to first step 230; whereas first step 230 defines the portion of cutting face 421 that is axially proximal substrate 210 and plane of intersection 419 as compared to second step 440. Thus, first step 230 is axially positioned between second step 440 and substrate 210. Riser 450 extends from first step 230 to second step 440, and thus, riser 450 is axially positioned between steps 230, 440.

Cutter element 400 is sized, and positioned and oriented on a drill bit (for example, drill bit 100) in the same manner as cutter element 200 previously described such that first step 230 contacts and engages the formation during drilling before second step 440. Accordingly, first step 230 may also be referred to herein as primary cutting surface 230 and second step 440 may also be referred to herein as secondary cutting surface 440, with the understanding primary cutting surface 230 and secondary cutting surface 440 are portions or subcomponents of the overall cutting face 421 of cutter element 400.

Referring still to FIGS. 10A-10D, primary cutting surface 230 is as previously described, and thus, is completely defined by planar surface 231 that extends radially and laterally from outer surface 422 and corresponding bevel 423*a* to riser 450. Planar surface 231 is disposed in a plane oriented perpendicular to central axis 215. Cutter element 400 is positioned and oriented on a drill bit (for example, drill bit 100) such that the portion of the edge at the intersection between primary cutting surface 230 and bevel 423*a* that is circumferentially centered on reference plane 429 in the top view of FIG. 10B contacts and engages the formation during drilling, and thus, defines cutting tip 233 of primary cutting surface 230. Cutter element 400 is positioned and oriented on a drill bit (for example, drill bit 100) in the same manner as cutter element 200 such that cutting tip 233 contacts and engages the formation during drilling, and defines the extension height of cutter element 400 when mounted to the drill bit.

Secondary cutting surface 440 extends radially and laterally from outer surface 422 and corresponding bevels 423*b*, 423*c*, 423*d* to riser 250. Unlike secondary cutting surface 240 previously described, in this embodiment, secondary cutting surface 440 is not defined by a single planar surface (for example, second planar surface 241). Rather, in this embodiment, secondary cutting surface 440 is generally convex or bowed outward in the front side view (FIG. 10C) and the lateral side view (FIG. 10D). In addition, in this embodiment, secondary cutting surface 440 is defined by a plurality of discrete regions or surfaces that intersect at linear boundaries or edges. More specifically, as best shown in FIGS. 10A and 10B, secondary cutting surface 440 includes a cutting region or surface 441 extending radially outward from central axis 215 to riser 450 and corresponding bevel 443*c*, a relief region or surface 442 extending radially outward from cutting region 441 and central axis 215 to outer surface 422 and corresponding bevel 423*d*, and a pair of lateral side regions or surfaces 446*a*, 446*b* extending radially and laterally from regions 441, 442 to outer surface 422, riser 450 and corresponding bevels 443*a*, 423*b*, 443*b*, 423*c*.

Cutting region 441 intersects bevel 443*c* along a radially outer, circumferentially extending edge that defines a cutting tip 444 of secondary cutting surface 440. Bevel 443*c*, cutting tip 444, and cutting tip 233 are generally centered on reference plane 429 as shown in the top view of FIG. 10B. Accordingly, bevel 443*c*, cutting tip 444, and cutting tip 233 are radially aligned relative to central axis 215. As best shown in FIG. 10B, cutting tip 444 is radially offset from cutting tip 233. In particular, cutting tips 233, 444 are radially spaced apart a radial offset distance R as previously described measured radially inward from cutting tip 233 to cutting tip 444 in top view.

Regions 441, 442, 446*a*, 446*b* are circumferentially disposed about axis 215. In addition, regions 441, 442, 446*a*, 446*b* are positioned circumferentially adjacent each other with each region 446*a*, 446*b* circumferentially disposed between regions 441, 442 and each region 441, 442 circumferentially disposed between regions 446*a*, 446*b*. Thus, region 441 extends circumferentially from region 446*a* to region 446*b*, region 442 extends circumferentially from region 446*a* to region 446*b*, region 446*a* extends circumferentially from region 441 to region 442, and region 446*b* extends circumferentially from region 441 to region 442. In this embodiment, regions 441, 442 are bisected by reference plane 429 and are angularly spaced 180° apart about axis 215. Accordingly, regions 441, 442 extend radially outward in opposite directions from central axis 215 and regions 446*a*, 446*b* extend radially outward in opposite directions from regions 441, 442.

A linear boundary or edge is provided at the intersection of each circumferentially adjacent region 441, 442, 446*a*, 446*b*. As shown in FIGS. 10A and 10B, regions 441, 442 intersect at a linear edge 445*a*, regions 441, 446*a* intersect at a linear edge 445*b*, regions 446*a*, 442 intersect at a linear edge 445*c*, regions 442, 446*b* intersect at a linear edge 445*d*, regions 446*b*, 441 intersect at a linear edge 445*e*. Each linear edge 445*b*, 445*c*, 445*d*, 445*e*, extends from an end of linear edge 445*a* to outer surface 422 and the intersection of circumferentially adjacent corresponding bevels 443*a*, 443*c*, 423*b*, 423*d*, 423*d*, 423*c*, 443*b*, 443*c*. As best shown in the top view of cutter element 400 in FIG. 10B (looking at secondary cutting surface 440 as viewed parallel to central axis 215 in top view), in this embodiment, linear edges 445*b*, 445*e* are oriented parallel to each other moving radially outward along cutting region 441 from central axis 215 and edge 445*a* to outer surface 422 and linear edges 445*c*, 445*d* taper or slope away from each other moving radially outward along relief region 422 from central axis 215 and edge 445*a* to outer surface 422. As a result, cutting region 441 has a width measured perpendicular to a reference plane 429 containing central axis 215 in top view that is constant moving radially outward from edge 445*a* and central axis 215 to outer surface 422, however, relief region 442 has a width measured perpendicular to reference plane 429 in top view that increases moving radially outward from edge 445*a* and central axis 215 to outer surface 422. In other embodiments, the width of the cutting region (for example, cutting region 441) and the width of the relief region (for example, relief region 442) may increase, decrease, or remain constant moving radially outward from the central axis (for example, central axis 215) to the outer surface (for example, outer surface 422).

Referring still to FIGS. 10A-10D, in this embodiment, each region 441, 442, 446*a*, 446*b* on secondary cutting surface 440 is planar, and thus, may also be referred to as "planar" surface or facet. In addition, in this embodiment, cutting facet 441 is disposed in a plane oriented perpendicular to axis 215 and is generally rectangular. Linear edge 445*a*, 445*b*, 445*e*, and bevel 423*c* define the four sides of the rectangular cutting region 441. Although cutting facet 441 is disposed in a plane oriented perpendicular to axis 215 in this embodiment, in other embodiments, the cutting facet (for example, cutting facet 441) can slope toward or away from the substrate (for example, substrate 210) moving radially outward from the central axis (for example, central axis 215).

Cutting surface 231 and planar cutting surface 441 are disposed in planes oriented parallel to each other and are spaced apart an axial distance $D_s$ as previously described. Thus, planar surface 231 of primary cutting surface 220 and planar cutting surface 441 of secondary cutting surface 440 may be described as being axially offset by the axial distance $D_s$.

As best shown in the front side view (FIG. 10C) (looking at cutter element 400 perpendicular to axis 215 and parallel to lateral facets 446*a*, 446*b*), in embodiments described herein, each lateral facet 446*a*, 446*b* slopes axially toward substrate 210 moving radially outward from facets 441, 442 to outer surface 422. In particular, each lateral facet 446*a*, 446*b* is oriented at a non-zero acute angle ω measured from the lateral facet 446*a*, 446*b* to a reference plane oriented perpendicular to central axis 215 in the front side view. In embodiments described herein, each angle ω is less than 45°, preferably ranges from 10° to 35°, and more preferably ranges from 12° to 27°. In general, angles ω can be the same or different. In this embodiment, angles ω are the same, and further, each angle ω is 14.5°.

As best shown in the lateral side view (FIG. 10D) (looking at cutter element 400 perpendicular to axis 215 and parallel to cutting facet 441 and relief facet 442), in this embodiment, relief facet 442 slopes axially toward substrate 210 moving radially outward from central axis 215 and edge 445*a* to bevel 423*d*. In particular, relief facet 442 is oriented at a non-zero acute angle n measured from facet 442 to a reference plane oriented perpendicular to central axis 215 in the lateral side view. Angle n is less than 45°, preferably ranges from 1° to 20°, and more preferably ranges from 2° to 10°. Although relief facet 442 slopes toward substrate 210 moving radially outward from central axis 215 and edge 445*a* to bevel 423*d* in this embodiment, in other embodiments, the relief facet (for example, relief facet 442) can be oriented perpendicular to the central axis (for example, central axis 215) or slope away from the substrate (for example, substrate 210) moving radially outward from the central axis.

As best shown in FIG. 10B, cutting facet 441 has a length $L_{441}$ measured parallel to plane 429 from edge 445*a* to bevel 443*c* in top view, and a width $W_{441}$ measured perpendicular to plane 429 from edge 445*b* to edge 445*e* in top view. The geometry of cutting facet 441 may be characterized by the ratio of the length $L_{441}$ to the diameter of cutter element 400 and an "aspect ratio" that is equal to the ratio of the length $L_{441}$ to the width $W_{441}$. In general, the diameter of a cutter element is the diameter of the base or substrate of the cutter element (for example, the diameter of substrate 201). The ratio of the length $L_{441}$ to the diameter of cutter element 400 is less than 1.0, alternatively ranges from 0.10 and 0.90, alternatively ranges from 0.20 and 0.80, and alternatively ranges from 0.25 and 0.75, and alternatively ranges from 0.33 and 0.66; and the aspect ratio of cutting face 441 is preferably less than 50.0, alternatively ranges from 0.10 and 30.0, alternatively ranges from 0.50 and 30.0, alternatively ranges from 1.0 and 10.0, and alternatively ranges from 1.0 and 5.0. In this embodiment, the aspect ratio of cutting facet 441 is 1.37.

Referring again to FIGS. 10A-10D, in this embodiment, riser 450 has a semi-cylindrical geometry and is symmetric about reference plane 429. More specifically, riser 450 is completely defined by a semi-cylindrical surface 451 that is bisected by reference plane 429. Bevel 443*c* is provided along the intersection of cutting facet 441 and surface 451 of riser 450, bevel 443*a* is provided along the intersection of lateral facet 446*a* and surface 451 of riser 450, and bevel 443*b* is provided along the intersection of lateral facet 446*b* and surface 451 of riser 450. The intersections of surface 451 with primary cutting surface 230 may be radiused to reduce stress concentrations at that location.

Referring now to FIG. 10D, semi-cylindrical surface 451 can be oriented perpendicular to or at an acute angle relative to central axis 215 in side view. More specifically, semi-cylindrical surface 451 is oriented at an angle σ as previously described measured relative to central axis 215. In this embodiment, semi-cylindrical surface 451 can be oriented parallel to central axis 215, and thus, angle σ is zero.

Cutter element 400 is mounted to a cutter supporting surface (for example, cutter supporting surface 144) of a blade (for example, blade 141, 142) of a drill bit (for example, drill bit 100) in the same manner as cutter element 200. For example, a plurality of cutter elements 400 can be positioned and oriented at the same backrake angle c as previously described, with cutting tips 233 defining the extension height (for example, extension height H) of the cutter elements 400, and with cutting tips 233 designed to contact and engage the formation before cutting tips 444. In addition, cutter element 400 functions in substantially the same manner as cutter element 200, and thus, offers the potential for the same benefits and advantages during drilling operations. In addition, when cutting tip 444 engages the formation, the sheared formation material slides along cutting facet 441 and lateral side regions 446*a*, 446*b* as secondary cutting surface 440 passes through the formation. The geometry of secondary cutting surface 440 is particularly designed to offer the potential to improving cutting efficiency and cleaning efficiency to increase rate of penetration (ROP) and durability of cutter element 400. In particular, the downward slope of region 442 toward substrate 210 moving from central axis 215 to outer surface 422 increases relief relative to the corresponding cutting surface 441 and cutting edge 444, which allows drilling fluid to be directed toward the cutting edge 444 and formation cuttings to efficiently slide along secondary cutting surface 440. The downward slope of lateral side regions 446*a*, 446*b* toward substrate 210 moving from central axis 215 to outer surface 422 allows secondary cutting surface 440 to draw the extrudates of formation material.

In the embodiments of cutter element 200, 300, 400 previously described, primary cutting surface 230, 330 is defined by a single planar surface 231, 331, respectively, that disposed in a plane oriented perpendicular to axis 215, 315, respectively. However, in other embodiments, the primary cutting surface (for example, primary cutting surface 230, 330) may be defined by a plurality of facets, one or more curved surfaces (for example, concave surface(s), convex surface(s), or both), or combinations thereof. Still further, in some embodiments, the primary cutting surface (for example, primary cutting surface 230, 330) may include one or more surfaces oriented at acute angles relative to the corresponding central axis (for example, axis 215, 315).

Referring now to FIGS. 11A-11D, an embodiment of a cutter element 500 that can be used on drill bit 100 in place of one or more cutter elements 200 is shown. Cutter element 500 is similar to cutter elements 200, 300, 400 previously described. For example, cutter element 500 is substantially the same as cutter element 400 previously described with the exception that a pair of planar flats are disposed along the cylindrical radially outer surfaces of the substrate and cutting layer, the primary cutting surface is V-shaped due to the planar flats (instead of generally semi-cylindrically shaped), and the primary cutting surface comprises a plurality of planar facets (instead of being defined by a single planar surface). Accordingly, the differences between cutter elements 200, 300, 400, 500 will be described it being understood the other features are generally the same. In addition, for purposes of clarity, like features of cutter element 500 and previously described cutter elements (for example, cutter elements 200, 300, 400) are given the same reference numerals.

In this embodiment, cutter element 500 includes a base or substrate 310 and a cutting layer 520 bonded to the substrate 310 at a reference plane of intersection 519. Substrate 310 is as previously described. Cutting layer 520 is made of an ultrahard material such as polycrystalline diamond (PCD) or other superabrasive material. First end 310*a* of substrate 310 is bonded to cutting layer 520 at the plane of intersection 519.

Cutting layer 520 has a first end 520*a* distal substrate 310, a second end 520*b* bonded to end 310*a* of substrate 310 at plane of intersection 519, and a radially outer surface 522 extending axially between ends 520*a*, 520*b*. In addition, as best shown in FIG. 11D, cutting layer 520 has an axial thickness $T_{cl}$ as previously described measured axially relative to central axis 315 between ends 520*a*, 520*b* in side view. In this embodiment, cutting layer 520 is generally disc-shaped, and thus, outer surface 522 is generally cylindrical. Outer surfaces 312, 522 of substrate 310 and cutting layer 522, respectively, are coextensive and contiguous such that there is a generally smooth transition moving axially between outer surfaces 312, 522.

The outer surface of cutting layer 520 at first end 520*a* defines a cutting face 521 of cutter element 500, which is designed and shaped to engage and shear the formation during drilling operations. In this embodiment, a plurality of chamfers or bevels 523*a*, 523*b*, 523*c*, 523*d*, 523*e*, 523*f*, 523*g*, 523*h* are provided at the intersections of cutting face 521 and radially outer surface 522.

In this embodiment, cutter element 500 and cutting face 521 are symmetric about a reference plane 529 that contains central axis 315 and bisects cutter element 500. In addition, similar to cutting faces 221, 321, 421 previously described, cutting face 521 has a stepped geometry that defines a plurality of cutting edges and cutting surfaces designed to engage and shear the formation at different times during drilling operations. In particular, cutting face 521 includes a first or lower step 530, a second or upper step 540 that is axially spaced from first step 530 relative to central axis 315, and a riser 550 extending from first step 530 to second step 540. Second step 540 defines the portion of cutting face 521 that is axially distal substrate 310 and plane of intersection 519 as compared to first step 530; whereas first step 530 defines the portion of cutting face 521 that is axially proximal substrate 310 and plane of intersection 519 as compared to second step 540. Thus, first step 530 is axially positioned between second step 540 and substrate 310. Riser 550 extends from first step 530 to second step 540, and thus, riser 550 is axially positioned between steps 530, 540.

Cutter element 500 is sized, and positioned and oriented on a drill bit (for example, drill bit 100) in the same manner as cutter element 200 previously described such that first step 530 contacts and engages the formation during drilling before second step 540. Accordingly, first step 530 may also be referred to herein as primary cutting surface 530 and second step 540 may also be referred to herein as secondary cutting surface 540, with the understanding primary cutting surface 530 and secondary cutting surface 540 are portions or subcomponents of the overall cutting face 521 of cutter element 500.

Figure 11A:
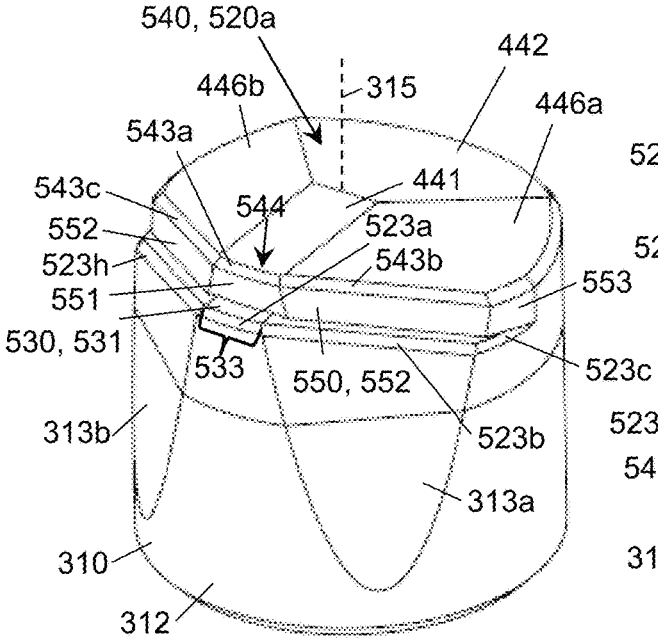
FIGS. 11A-11D are perspective, top, front, and side views, respectively, of an embodiment of a cutter element in accordance with principles described herein.
Figure 11B:
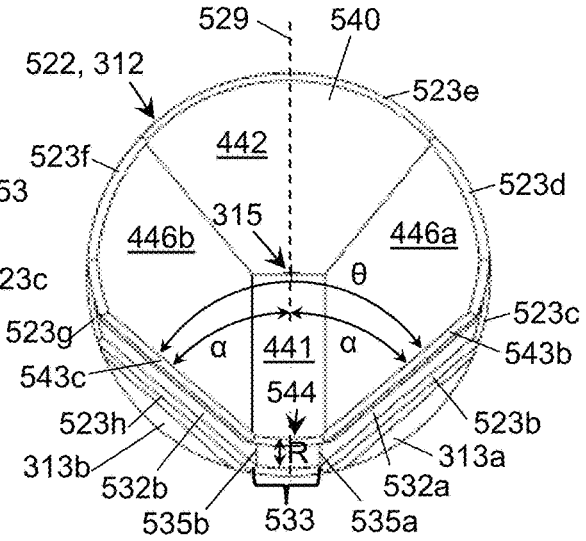
Figure 11C:
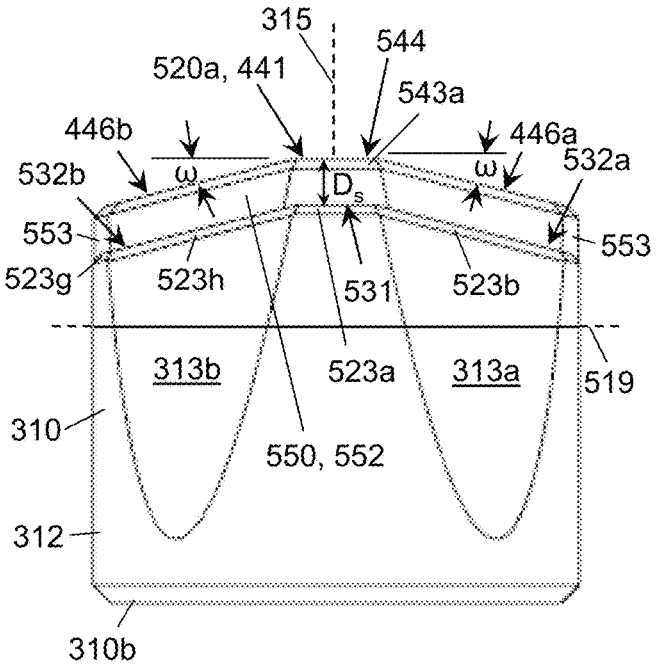
Figure 11D:
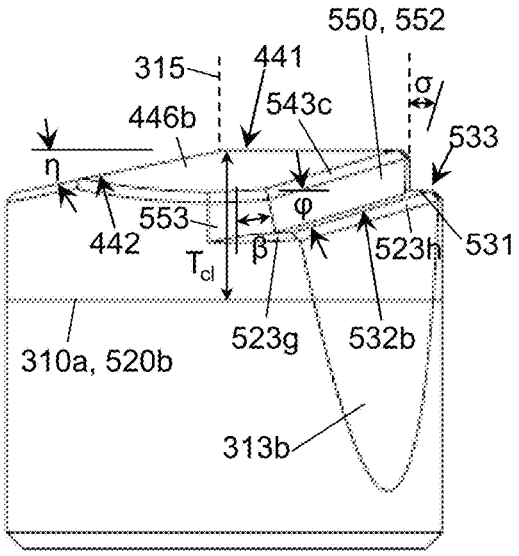

Referring still to FIGS. 11A-11D, unlike primary cutting faces 230, 330 previously described, in this embodiment, primary cutting surface 530 is not completely defined by a single planar surface (for example, planar surface 231). Rather, in this embodiment, primary cutting surface 530 is generally convex or bowed axially outward in the front side view (FIG. 11C) and the lateral side view (FIG. 11D). In addition, in this embodiment, primary cutting surface 530 is defined by a plurality of discrete regions or surfaces that intersect at linear boundaries or edges. More specifically, as best shown in FIGS. 11A and 11B, primary cutting surface 530 includes a cutting region or surface 531 extending radially outward from riser 550 to corresponding bevel 523*a* and a pair of lateral side regions or surfaces 532*a*, 532*b* extending laterally from region 531 and extending radially from riser 550 to corresponding bevels 523*b*, 523*c* and bevels 523*h*, 523*g*, respectively. Thus, region 531 extends circumferentially from region 532*a* to region 532*b*. In this embodiment, region 531 is bisected by reference plane 529 and regions 532*a*, 532*b* are disposed on opposite sides of reference plane 529 and symmetric relative to reference plane 529. Accordingly, regions 532*a*, 532*b* extend laterally and circumferentially outward in opposite directions from region 531. Still further, bevel 523*a* is circumferentially positioned between bevels 523*b*, 523*h* and is bisected by reference plane 529. Cutter element 500 is positioned and oriented on a drill bit (for example, drill bit 100) such that the edge at the intersection between cutting region 531 and bevel 523*a*, which is circumferentially centered on reference plane 529 in the top view of FIG. 11B, contacts and engages the formation during drilling, and thus, defines cutting tip 533 of primary cutting surface 530. Cutter element 500 is positioned and oriented on a drill bit (for example, drill bit 100) in the same manner as cutter element 200 such that cutting tip 533 contacts and engages the formation during drilling, and defines the extension height of cutter element 500 when mounted to the drill bit.

A linear boundary or edge is provided at the intersection of each circumferentially adjacent region 531, 532*a*, 532*b*. As shown in the top view of cutter element 500 of FIG. 11B (looking at secondary cutting surface 530 as viewed parallel to central axis 315 in top view), regions 531, 532*a* intersect at a linear edge 535*a* and regions 531, 532*b* intersect at a linear edge 535*b*. Each linear edge 535*a*, 535*b* extends radially outward from riser 550 to the intersection between circumferentially adjacent bevels 523*a*, 523*b* and bevels 523*a*, 523*h*, respectively. In this embodiment, linear edges 535*a*, 535*b* are oriented parallel to each other moving radially outward along cutting region 531 from riser 550 to bevel 523*a*. As a result, cutting region 531 has a width measured perpendicular to a reference plane 529 that is constant moving radially outward from riser 550 to bevel 523*a*. In other embodiments, the width of the cutting region (for example, cutting region 531) may increase, decrease, or otherwise vary.

Referring again to FIGS. 11A-11D, in this embodiment, each region 531, 532*a*, 532*b* on primary cutting surface 530 is planar, and thus, may also be referred to as "planar" surface or facet. In addition, in this embodiment, cutting facet 531 is disposed in a plane oriented perpendicular to axis 315 and is generally rectangular. Linear edge 535*a*, 535*b*, riser 550, and bevel 523*a* define the four sides of the rectangular cutting region 531. Although cutting facet 531 is disposed in a plane oriented perpendicular to axis 315 in this embodiment, in other embodiments, the cutting facet (for example, cutting facet 531) can slope toward or away from the substrate (for example, substrate 310) moving radially outward from the central axis (for example, central axis 315).

As best shown in the lateral side view of FIG. 11D, in this embodiment, each lateral facet 532*a*, 532*b* slopes axially toward substrate 310 moving radially from bevels 523*b*, 523*h*, respectively, to riser 550. In particular, each lateral facet 532*a*, 532*b* is oriented at a non-zero acute angle $\varphi$ measured from the lateral facet 532*a*, 532*b* to a reference plane oriented perpendicular to central axis 315 in the lateral side view. In embodiments described herein, each angle $\varphi$ is less than 45°, preferably ranges from 5° to 25°, and more preferably ranges from 5° to 10°. In general, angles $\omega$ can be the same or different. In this embodiment, angles $\omega$ are the same, and further, each angle $\varphi$ is 14.5°. Still further, in this embodiment, both lateral facets 532*a*, 532*b* are disposed in a common plane oriented at acute angle $\varphi$ relative to a reference plane oriented perpendicular to central axis 315.

Referring again to FIGS. 11A-11D, secondary cutting surface 540 extends radially and laterally from outer surface 522 and corresponding bevels 523*d*, 523*e*, 523*f* to riser 550. Secondary cutting surface 540 is similar to secondary cutting surface 440 previously described. Namely, secondary cutting surface 540 is generally convex or bowed axially outward in the front side view (FIG. 11C) and the lateral side view (FIG. 11D). More specifically, secondary cutting surface 540 is defined by a cutting region 441 extending radially outward from central axis 315 to riser 450 and a corresponding bevel 543*a*, a relief region or surface 442 extending radially outward from cutting region 441 and central axis 315 to outer surface 522 and corresponding bevel 523*e*, and a pair of lateral side regions or surfaces 446*a*, 446*b* extending radially and laterally from regions 441, 442 to outer surface 522, riser 550, and corresponding bevels 523*d*, 543*b*, and bevels 523*f*, 543*c*, respectively. Regions 441, 442, 446*a*, 446*b* are each as previously described.

Cutting region 441 intersects bevel 543*a* along a radially outer, circumferentially extending edge that defines a cutting tip 544 of secondary cutting surface 540. Bevel 543*a*, cutting tip 544, and cutting tip 533 are generally centered on reference plane 529 as shown in the top view of FIG. 11B. Accordingly, bevel 543*a*, cutting tip 544, and cutting tip 533 are radially aligned relative to central axis 515. As best shown in FIG. 11B, cutting tip 544 is radially offset from cutting tip 533. In particular, cutting tips 533, 544 are radially spaced apart a radial offset distance R as previously described measured radially inward from cutting tip 533 to cutting tip 544 in top view.

As best shown in FIGS. 11C and 11D, planar cutting surfaces 531, 441 are disposed in planes oriented parallel to each other and are spaced apart an axial distance $D_s$ as previously described. Thus, planar cutting surface 531 of primary cutting surface 530 and planar cutting surface 441 of secondary cutting surface 540 may be described as being axially offset by the axial distance $D_s$.

Referring again to FIGS. 11A-11D, in this embodiment, riser 550 has a V-shaped geometry and is symmetric about reference plane 529. More specifically, riser 550 includes a central surface 551, a pair of lateral surfaces 552 extending linearly from central surface 551 toward radially outer surface 522, and a pair of transition surfaces 553 extending from lateral surfaces 552 to radially outer surface 522. Central surface 551 is spaced from and does not intersect radially outer surface 522, is positioned between lateral surfaces 552, and is bisected by reference plane 529 as shown in the top view of FIG. 11B. In this embodiment, central surface 551, lateral surfaces 552, and transition surfaces 553 are planar surfaces. It should be appreciated that due to the V-shaped geometry of riser 550, second step 540 also has a V-shaped geometry.

Bevel 543*a* is provided along the intersection of central surface 551 of riser 550 and cutting region 441, and one bevel 543*b*, 543*c* is provided along the intersection of each lateral surface 552 of riser 550 and lateral side region 446*a*, 446*b*, respectively. Thus, central surface 551 of riser 550 extends laterally relative to reference plane 529 between lateral surfaces 552 and extends axially from primary cutting surface 530 to bevel 543*a*; and each lateral surface 552 of riser 550 extends laterally relative to reference plane 529 from central surface 551 to the corresponding transition surface 553 and extends axially from primary cutting surface 530 to the corresponding bevel 543*b*, 543*c*. The intersections of surfaces 551, 552, 553 with primary cutting surface 530 may be radiused to reduce stress concentrations at those locations.

As best shown in FIG. 11B, each lateral surface 552 and corresponding bevel 543*b*, 543*c* is angularly spaced from reference plane 529 by an acute angle σ as previously described in top view, and lateral surfaces 552 and bevels 543*b*, 543*c* are angularly spaced from each other by an angle θ as previously described in top view. As best shown in FIG. 11D, central surface 551 and lateral surfaces 552 are planar surfaces that can be oriented perpendicular to or at acute angles σ, β as previously described relative to central axis 315 in side view.

Referring again to FIGS. 11A-11D, cutter element 500 includes a pair of planar surfaces or flats 313*a*, 313*b* as previously described extending across outer surfaces 312, 522 of substrate 310 and cutting layer 520, respectively. Each flat 313*a*, 313*b* extends axially from a corresponding bevel 523*b*, 523*h* and primary cutting surface 530 along outer surface 522 of cutting layer 520 and across plane of intersection 519 into and along outer surface 312 of substrate 310. Thus, bevel 523*a* is positioned between lateral side region 532*a* and flat 313*a*, and bevel 523*b* is positioned between lateral side region 532*b* and flat 313*b*.

Cutter element 500 is mounted to a cutter supporting surface (for example, cutter supporting surface 144) of a blade (for example, blade 141, 142) of a drill bit (for example, drill bit 100) in the same manner as cutter element 200. For example, a plurality of cutter elements 500 can be positioned and oriented at the same backrake angle c as previously described, with cutting tips 533 defining the extension height (for example, extension height H) of the cutter elements 500, and with cutting tips 533 designed to contact and engage the formation before cutting tips 544. In addition, cutter element 500 functions in substantially the same manner as cutter element 200, and thus, offers the potential for the same benefits and advantages during drilling operations. In addition, when cutting tip 544 engages the formation, the sheared formation material slides along cutting facet 441 and lateral side regions 446*a*, 446*b* as secondary cutting surface 540 passes through the formation. Similar to secondary cutting surface 440 previously described, the geometry of secondary cutting surface 540 is particularly designed to offer the potential to improving cutting efficiency and cleaning efficiency to increase rate of penetration (ROP) and durability of cutter element 500.

In the embodiments of cutter elements 200, 300, 400, 500 previously described, each cutting tip 233, 244, 333, 444, 533, 544 is defined by a single, continuous edge. However, in other embodiments, the cutting tip of the primary cutting surface (for example, primary cutting surface 230, 330, 530), the cutting tip of the secondary cutting surface (for example, secondary cutting surface 240, 440, 540), or both may be defined by a plurality of cutting edges.

Referring now to FIGS. 12A-12D, an embodiment of a cutter element 600 that can be used on drill bit 100 in place of one or more cutter elements 200 is shown. Cutter element 600 is similar to cutter elements 200, 300, 400, 500 previously described. For example, cutter element 600 is substantially the same as cutter element 300 previously described with the exception that the cutting tip of the secondary cutting surface includes a plurality of cutting edges and the secondary cutting surface comprises a plurality of planar facets (instead of being defined by a single planar surface). Accordingly, the differences between cutter elements 200, 300, 400, 500 will be described it being understood the other features are generally the same. In addition, for purposes of clarity, like features of cutter element 500 and previously described cutter elements (for example, cutter elements 200, 300, 400, 500) are given the same reference numerals.

In this embodiment, cutter element 600 includes a base or substrate 310 and a cutting layer 620 bonded to the substrate 310 at a reference plane of intersection 619. Substrate 310 is as previously described. Cutting layer 620 is made of an ultrahard material such as polycrystalline diamond (PCD) or other superabrasive material. First end 310*a* of substrate 310 is bonded to cutting layer 620 at the plane of intersection 619.

Cutting layer 620 has a first end 620*a* distal substrate 310, a second end 620*b* bonded to end 310*a* of substrate 310 at plane of intersection 619, and a radially outer surface 622 extending axially between ends 620*a*, 620*b*. In addition, as best shown in FIG. 12D, cutting layer 620 has an axial thickness $T_{cl}$ as previously described measured axially relative to central axis 315 between ends 620*a*, 620*b* in side view. In this embodiment, cutting layer 620 is generally disc-shaped, and thus, outer surface 622 is generally cylindrical. Outer surfaces 312, 622 of substrate 310 and cutting layer 622, respectively, are coextensive and contiguous such that there is a generally smooth transition moving axially between outer surfaces 312, 622.

The outer surface of cutting layer 620 at first end 620*a* defines a cutting face 621 of cutter element 600, which is designed and shaped to engage and shear the formation during drilling operations. In this embodiment, a plurality of chamfers or bevels 323*a*, 323*b*, 323*c*, 623 are provided at the intersections of cutting face 621 and radially outer surface 622.

In this embodiment, cutter element 600 and cutting face 621 are symmetric about a reference plane 629 that contains central axis 315 and bisects cutter element 600. In addition, similar to cutting faces 221, 321, 421, 521 previously described, cutting face 621 has a stepped geometry that defines a plurality of cutting edges and cutting surfaces designed to engage and shear the formation at different times during drilling operations. In particular, cutting face 621 includes a first or lower step 330 as previously described, a second or upper step 640 that is axially spaced from first step 330 relative to central axis 315, and a riser 650 extending from first step 330 to second step 640. Second step 640 defines the portion of cutting face 621 that is axially distal substrate 310 and plane of intersection 619 as compared to first step 330; whereas first step 330 defines the portion of cutting face 621 that is axially proximal substrate 310 and plane of intersection 619 as compared to second step 640. Thus, first step 330 is axially positioned between second step 640 and substrate 310. Riser 650 extends from first step 330 to second step 640, and thus, riser 650 is axially positioned between steps 330, 640. Cutter element 600 is positioned and oriented on a drill bit (for example, drill bit 100) in the same manner as cutter element 300 such that cutting tip 333 of primary cutting surface 330 contacts and engages the formation during drilling, and defines the extension height of cutter element 600 when mounted to the drill bit.

Cutter element 600 is sized, and positioned and oriented on a drill bit (for example, drill bit 100) in the same manner as cutter element 200 previously described such that first step 330 contacts and engages the formation during drilling before second step 640. Accordingly, first step 330 may also be referred to herein as primary cutting surface 330 and second step 640 may also be referred to herein as secondary cutting surface 640, with the understanding primary cutting surface 330 and secondary cutting surface 640 are portions or subcomponents of the overall cutting face 621 of cutter element 600.

Figure 12A:
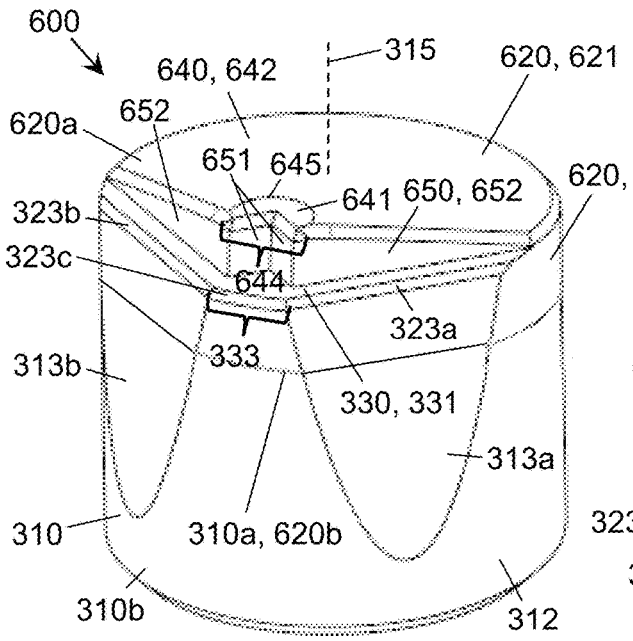
FIGS. 12A-12D are perspective, top, front, and side views, respectively, of an embodiment of a cutter element in accordance with principles described herein.
Figure 12B:
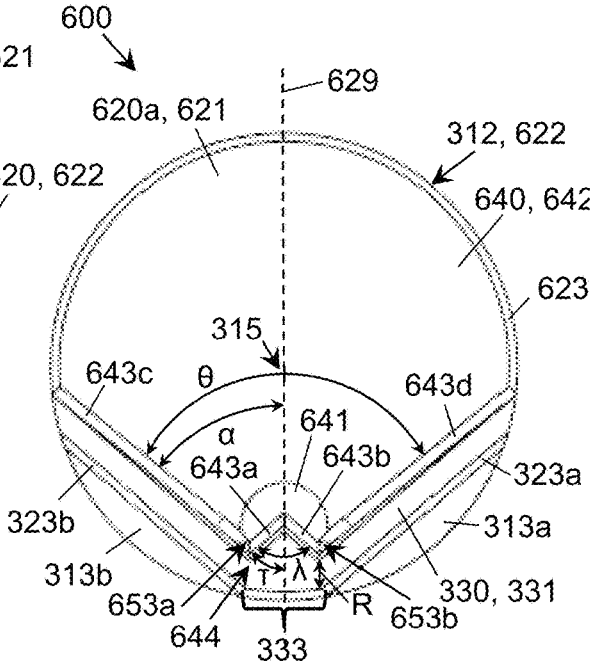
Figure 12C:
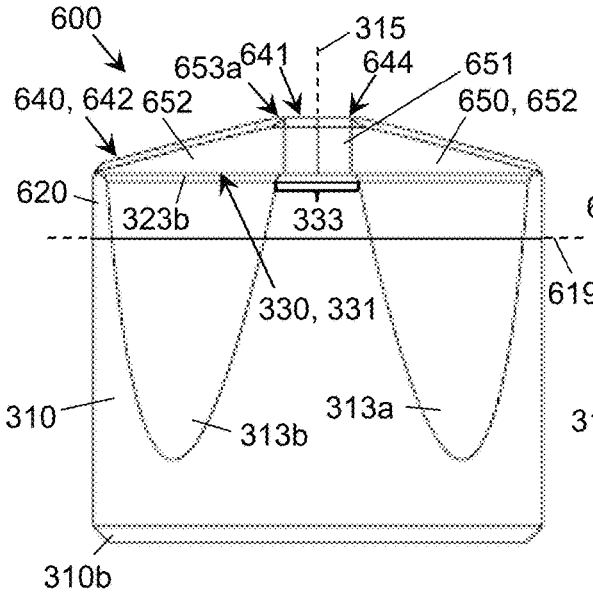
Figure 12D:
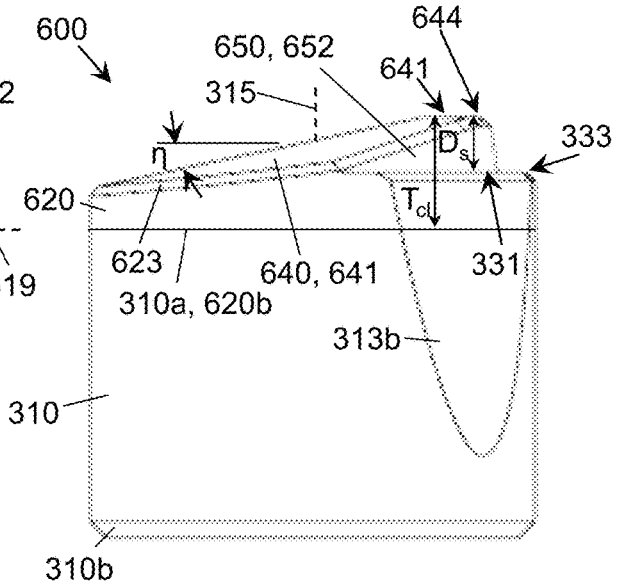

Referring still to FIGS. 12A-12D, unlike secondary cutting face 240, previously described, in this embodiment, secondary cutting face 640 is not completely defined by a single planar surface (for example, planar surface 231). Rather, in this embodiment, secondary cutting face 640 is generally convex or bowed axially outward in the front side view (FIG. 12C) and the lateral side view (FIG. 12D). In addition, in this embodiment, secondary cutting face 640 is defined by a plurality of discrete regions or surfaces that intersect at boundaries or edges. More specifically, as best shown in FIGS. 12A and 12B, secondary cutting face 640 includes a cutting region or surface 641 extending from riser 650 and corresponding bevels 643*a*, 643*b* and a relief region or surface 642 extending laterally and radially from region 641 to corresponding bevels 643*c*, 643*d*, 623. Relief region 642 generally extends about cutting region 641, and extends from bevels 643*c*, 643*d*, 623 to cutting region 641. In this embodiment, regions 641, 642 are bisected by reference plane 629 and are symmetric relative to reference plane 629. Cutter element 600 is positioned and oriented on a drill bit (for example, drill bit 100) such that the edges at the intersections between cutting region 641 and bevels 643*a*, 643*b*, 643*c*, 643*d* contact and engage the formation during drilling, and thus, define cutting tip 644 of secondary cutting face 640.

Bevels 643*a*, 643*b*, cutting tip 644, and cutting tip 333 are generally centered on reference plane 629 as shown in the top view of FIG. 12B. Accordingly, cutting tips 644, 333 533 are radially aligned relative to central axis 315. As best shown in FIG. 12B, cutting tip 644 is radially offset from cutting tip 333. In particular, cutting tips 333, 644 are radially spaced apart a radial offset distance R as previously described measured radially inward from cutting tip 333 to cutting tip 644 in top view.

As shown in the top view of cutter element 600 of FIG. 12B (looking at secondary cutting surface 640 as viewed parallel to central axis 315 in top view), regions 641, 642 intersect at a semi-circular edge 645 that is centered relative to reference plane 629. As a result, cutting region 641 may be described as having a radius equal to the radius of semi-circular edge 645. In addition, cutting tips 633, 644 have widths measured perpendicular to plane 629 in top view. The width of cutting tip 644 is less than the width of cutting tip 633.

Referring again to FIGS. 12A-12D, in this embodiment, each region 641, 642 on secondary cutting surface 640 is planar, and thus, may also be referred to as "planar" surface or facet. In addition, in this embodiment, cutting facet 641 is disposed in a plane oriented perpendicular to axis 315. Although cutting facet 641 is disposed in a plane oriented perpendicular to axis 315 in this embodiment, in other embodiments, the cutting facet (for example, cutting facet 531) can slope toward or away from the substrate (for example, substrate 310) moving radially outward from the central axis (for example, central axis 315).

As best shown in the lateral side view (FIG. 12D) (looking at cutter element 600 perpendicular to axis 315 and parallel to cutting facet 641 and relief facet 642), in this embodiment, relief facet 642 slopes axially toward substrate 310 moving from cutting facet 641 and bevels 643*c*, 643*d* to bevel 623. In particular, relief facet 642 is oriented at a non-zero acute angle n as previously described measured from facet 642 to a reference plane oriented perpendicular to central axis 315 in the lateral side view. Although relief facet 442 slopes toward substrate 310 moving from cutting facet 641 and bevels 643*c*, 643*d* to bevel 623 in this embodiment, in other embodiments, the relief facet (for example, relief facet 642) can be oriented perpendicular to the central axis (for example, central axis 315) or slope away from the substrate (for example, substrate 310) moving from the cutting facet (for example, cutting facet 641).

As best shown in FIGS. 12C and 12D, planar cutting surfaces 331, 641 are disposed in planes oriented parallel to each other and are spaced apart an axial distance $D_s$ as previously described. Thus, planar cutting surface 331 of primary cutting surface 330 and planar cutting surface 641 of secondary cutting surface 640 may be described as being axially offset by the axial distance $D_s$.

Referring again to FIGS. 12A-12D, in this embodiment, riser 650 has a W-shaped geometry and is symmetric about reference plane 629. More specifically, riser 650 includes a pair of central surfaces 651 and a pair of lateral surfaces 652 extending linearly from a corresponding central surface 651 toward radially outer surface 622. Central surfaces 651 are spaced from and do not intersect radially outer surface 622 and are positioned between lateral surfaces 652. In this embodiment, each surface 651, 652 is planar. As best shown in the top view of FIG. 12B, central surfaces 651 intersect at reference plane 629 and generally taper away from each other moving radially outward toward cutting tip 333 and laterally toward lateral surfaces 652, and lateral surfaces 652 generally taper away from each moving radially inward away from cutting tip 333 and laterally toward bevel 623. As a result, central surfaces 651 intersect to form a concave, V-shaped recess along riser 650, and each central surface 651 intersects a corresponding lateral surface 652 to form a convex V-shaped projection along riser 650. The V-shaped recess is centered on reference plane 629 and the pair of convex V-shaped projections are laterally disposed on opposite sides of the V-shaped recess and reference plane 629, thereby defining the W-shaped riser 650. It should be appreciated that due to the W-shaped geometry of riser 650, second step 640 also has a W-shaped geometry. One bevel 643*a*, 643*b* is provided along the intersection between each central surface 651 and cutting facet 641, and one bevel 643*c*, 643*d* is provided along the intersection between each lateral surface 652 and relief facet 642. The intersections of surfaces 651, 652 with primary cutting surface 330 may be radiused to reduce stress concentrations at those locations.

As best shown in FIG. 12B, each lateral surface 652 and corresponding bevel 643*c*, 643*d* is angularly spaced from reference plane 629 by an acute angle $\sigma$ as previously described in top view, and lateral surfaces 652 and bevels 643*c*, 643*d* are angularly spaced from each other by an angle $\theta$ as previously described in top view. In addition, each central surface 651 and corresponding bevel 643*a*, 643*b* is angularly spaced from reference plane 629 by an acute angle $\tau$ in top view, and central surfaces 651 and corresponding bevels 643*a*, 643*b* are angularly spaced from each other by an angle $\lambda$. In embodiments described herein, each angle $\tau$ is an acute angle ranging from 35° to 70°, and alternatively ranging from 45° to 50°; and angle $\lambda$ ranges from 70° to 140°, and alternatively ranges from 90° to 100°. In this embodiment, each angle $\tau$ is the same, and in particular, is 45°, and thus, angle $\lambda$ is 90°. In other embodiments, angles $\tau$ may not be the same. Central surfaces 651 and lateral surfaces 652 are planar surfaces that are disposed in planes that can be oriented perpendicular to or at acute angles relative to central axis 315 in side views looking parallel to surfaces 651, 652.

Due to the W-shaped geometry of riser 650, cutting tip 644 includes a plurality of cutting edges at the intersections of cutting facet 641 and bevels 643*a*, 643*b*, 643*c*, 643*d* and a pair of cutting V-shaped projections or peaks 653*a*, 653*b* at the intersection of the edges between cutting facet 641, bevel 643*b*, and bevel 643*d* and at the intersection of the edges between cutting facet 641, bevel 643*a*, and bevel 643*c*. When cutting tip 644 comes into contact with the formation during drilling, the V-shaped peaks 653*a*, 653*b* present a relatively aggressive geometry to the formation that may enhance cutting efficiency.

Referring again to FIGS. 12A-12D, cutter element 600 includes a pair of planar surfaces or flats 313*a*, 313*b* as previously described extending across outer surfaces 312, 622 of substrate 310 and cutting layer 620, respectively. Each flat 313*a*, 313*b* extends axially from a corresponding bevel 323*a*, 323*b* and primary cutting surface 330 along outer surface 622 of cutting layer 620 and across plane of intersection 619 into and along outer surface 312 of substrate 310. Thus, bevel 323*b* is positioned between planar surface 331 and flat 313*b*, and bevel 323*a* is positioned between planar surface 331 and flat 313*a*.

Cutter element 600 is mounted to a cutter supporting surface (for example, cutter supporting surface 144) of a blade (for example, blade 141, 142) of a drill bit (for example, drill bit 100) in the same manner as cutter element 200. For example, a plurality of cutter elements 600 can be positioned and oriented at the same backrake angle c as previously described, with cutting tips 333 defining the extension height (for example, extension height H) of the cutter elements 600, and with cutting tips 333 designed to contact and engage the formation before cutting tips 644. In addition, cutter element 600 functions in substantially the same manner as cutter element 200, and thus, offers the potential for the same benefits and advantages during drilling operations. In addition, the aggressive geometry of V-shaped peaks 653*a*, 653*b* along cutting tips 644 offers the potential for improved cutting efficiency or initiation and propagation of cracks in the formation when cutting tips 644 comes into engagement with the formation.

In the embodiments of cutter elements 200, 300, 400, 500, 600 previously described, one primary cutting tip 233, 333, 533 is provided and one secondary cutting tip 244, 444, 544, 644 is provided. However, in other embodiments, a plurality of primary cutting tips (e.g., cutting tips 233, 333, 533) and a plurality of secondary cutting tips (e.g., secondary cutting tips 244, 444, 544, 644) can be provided.

Figure 13A:
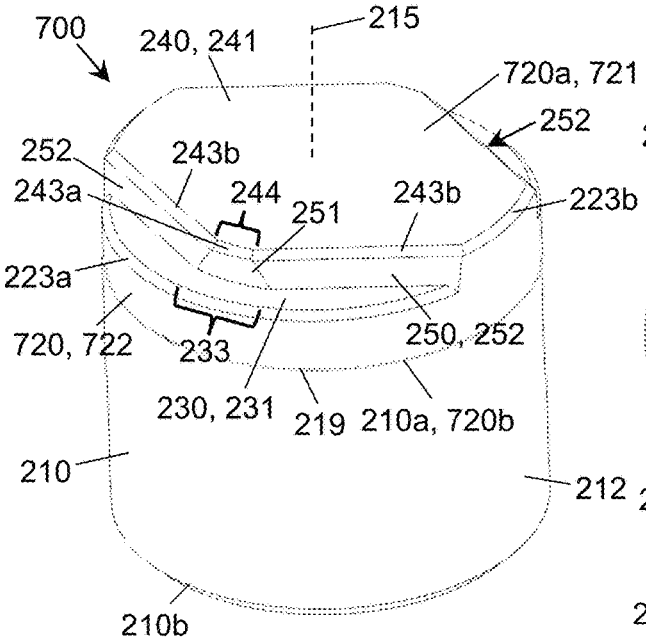
FIGS. 13A-13C are perspective, top, and side views, respectively, of an embodiment of a cutter element in accordance with principles described herein.
Figure 13B:
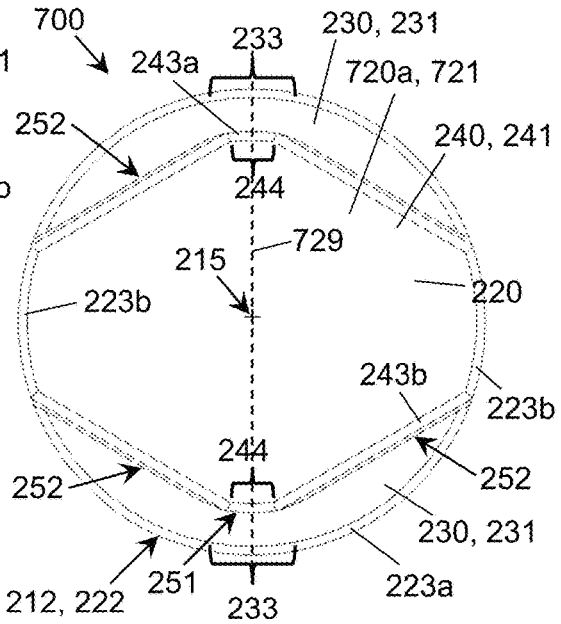
Figure 13C:
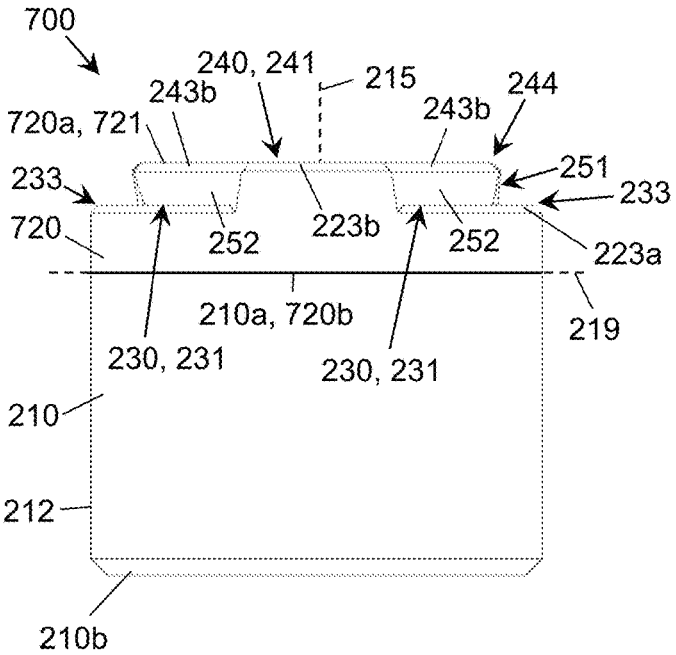

Referring now to FIGS. 13A-13C, an embodiment of a cutter element 700 that can be used on drill bit 100 in place of one or more cutter elements 200 is shown. Cutter element 700 is similar to cutter elements 200, 300, 400, 500 previously described. For example, cutter element 700 is substantially the same as cutter element 200 previously described with the exception that cutter element 700 includes a plurality of primary cutting tips and a plurality of secondary cutting tips. Accordingly, the differences between cutter elements 200, 700 will be described it being understood the other features are generally the same. In addition, for purposes of clarity, like features of cutter elements 200, 700 are given the same reference numerals.

In this embodiment, cutter element 700 includes a base or substrate 210 and a cutting layer 720 bonded to the substrate 210 at a reference plane of intersection 719. Substrate 210 is as previously described. Cutting layer 720 is made of an ultrahard material such as polycrystalline diamond (PCD) or other superabrasive material. First end 210*a* of substrate 210 is bonded to cutting layer 720 at the plane of intersection 719.

Cutting layer 720 has a first end 720*a* distal substrate 210, a second end 720*b* bonded to end 210*a* of substrate 210 at plane of intersection 719, and a radially outer surface 722 extending axially between ends 720*a*, 720*b*. In addition, cutting layer 720 has an axial thickness $T_{cl}$ as previously described measured axially relative to central axis 215 between ends 720*a*, 720*b* in side view. In this embodiment, cutting layer 720 is generally disc-shaped, and thus, outer surface 722 is generally cylindrical. Outer surfaces 212, 722 of substrate 210 and cutting layer 722, respectively, are coextensive and contiguous such that there is a generally smooth transition moving axially between outer surfaces 212, 722.

The outer surface of cutting layer 720 at first end 720*a* defines a cutting face 721 of cutter element 700, which is designed and shaped to engage and shear the formation during drilling operations. Cutter element 700 and cutting face 721 are symmetric about a reference plane 729 that contains central axis 215 and bisects cutter element 700. In this embodiment, cutting face 721 has a stepped geometry including a pair of circumferentially-spaced primary cutting surfaces 230, a secondary cutting surface 240, and a riser 250 extending from each primary cutting surface 230 to secondary cutting surface 240. Cutting surfaces 230, 240 and risers 250 are as previously described. Each riser 250 has a V-shaped geometry and is symmetric about a reference plane 729. In addition, a bevel 223*a* as previously described is provided at the intersection of each primary cutting surface 230 and outer surface 722, bevels 223*b* are provided at the intersections of secondary cutting surface 240 and outer surface 722, and bevels 243*a*, 243*b* as previously described are provided at the intersection of secondary cutting surface 240 and each riser 250. Each bevel 223*a*, 243*a* and corresponding cutting tips 233, 244 are circumferentially centered on reference plane 729. Thus, in this embodiment, the pair of bevels 223*a* are angularly spaced 180° apart about axis 215, the pair of bevels 243*a* are angularly spaced 180° apart about axis 215, the pair of primary cutting tips 233 are angularly spaced 180° apart about axis 215, the pair of secondary cutting tips 244 are angularly spaced 180° apart about axis 215, the pair of risers 250 are angularly spaced 180° apart about axis 215, and the pair of primary cutting surfaces 230 are angularly spaced 180° apart about axis 215.

Cutter element 700 is mounted to a cutter supporting surface (for example, cutter supporting surface 144) of a blade (for example, blade 141, 142) of a drill bit (for example, drill bit 100) in the same manner as cutter element 200. For example, a plurality of cutter elements 700 can be positioned and oriented at the same backrake angle c as previously described, with cutting tips 233 of corresponding primary cutting surfaces 230 defining the extension height (for example, extension height H) of the cutter elements 700, and with such cutting tips 233 designed to contact and engage the formation before cutting tips 244. In addition, cutter element 700 functions in substantially the same manner as cutter element 200, and thus, offers the potential for the same benefits and advantages during drilling operations.

As previously described, embodiments of cutter elements 700 include a plurality of circumferentially-spaced primary cutting tips 233 and a plurality of circumferentially-spaced secondary cutting tips 244. In the embodiment of cutter element 700 shown in FIGS. 13A-13C, two uniformly circumferentially-spaced primary cutting tips 233 and two uniformly circumferentially-spaced secondary cutting tips 244 are provided, with each primary cutting tip 233 being radially aligned with a corresponding secondary cutting tip 244. Thus, each cutter element 700 can be oriented such that one of the primary cutting tips 233 and the corresponding secondary cutting tip 244 of cutter element 700 are used first to engage, penetrate, and shear the formation in the manner previously described, and then when those cutting tips 233, 244 are sufficiently worn (e.g., the cutting efficiency and rate of penetration of the bit are sufficiently low), cutter element 700 can be removed from the bit body 110, rotated 180° about axis 215, and then re-mounted to bit body 110 with the other primary cutting tip 233 and corresponding secondary cutting tip 244 positioned to engage, penetrate and shear the formation in the manner previously described. Since this embodiment of cutter element 700 includes two sets of cutting tips 233, 244, cutter element 700 can be removed, remounted, and reused once. The ability to reuse cutter element 700 after one primary cutting tip 233 and corresponding secondary cutting tip 244 are sufficiently worn offers the potential to significantly increase the operating lifetime of cutter element 700.

As previously described, the length of time it takes to drill to the desired depth and location impacts the cost of drilling operations, and further, the geometry and shape of the cutting faces of the cutter elements impact bit durability and rate of penetration (ROP), and thus, are important to the success of a particular bit design. Friction arising during drilling between the cutting faces and the formation being drilled, and related drag, can undesirably reduce bit durability and ROP. To reduce friction between the cutting faces and the formation during drilling, the planar cutting faces of many conventional cutter elements are polished. However, current trends in cutter element designs include cutting faces with multiple planar surfaces, one or more non-planar surfaces, or combinations thereof that may be particularly difficult and time consuming to polish. Accordingly, embodiments of cutter elements described herein may include cutting faces with select surfaces having finishes (other than polished finishes) that offer the potential to reduce friction and drag between the select surfaces and the formation being cut. In particular, embodiments described herein may include primary cutting surfaces and risers with surface finishes designed to reduce friction and drag between such surfaces and the formation being cut.

Referring again to FIGS. 6A-6D, in this embodiment of cutter element 200, primary cutting surface 230 (and corresponding first planar surface 231) and riser 250 (and corresponding surfaces 251, 252) comprise a surface finish 850 to reduce friction and drag (i) between primary cutting surface 230 and the formation being cut with cutter element 200 and (ii) between riser 250 and the formation being cut with cutter element 200. In this embodiment, surface finish 850 completely covers the entirety of surfaces 231, 251, 252 of primary cutting surface 230 and riser 250. In addition, in this embodiment, each surface 231, 251, 252 comprises the same surface finish 850 shown in FIGS. 14A-14C, which will be described in detail below. However, in other embodiments, select portions of the primary cutting surface (e.g., primary cutting surface 230) and/or select portions of the riser (e.g., riser 250) may comprise the surface finish (e.g., surface finish 850), and further, in other embodiments, different surface finishes (e.g., different surface finishes 850) may be used on different surfaces (e.g., on different surfaces 231, 251, 252).

Figure 14A:
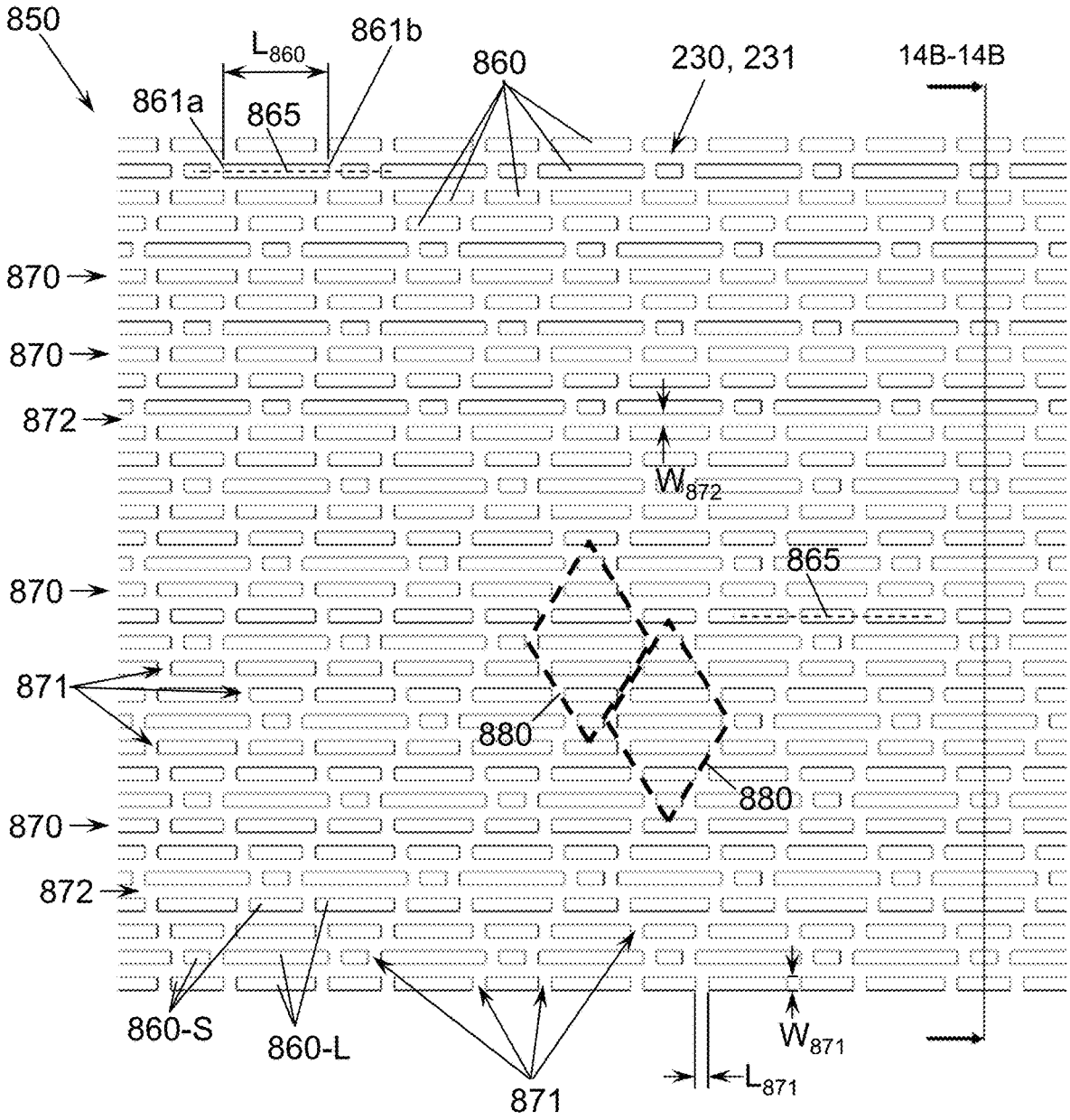
FIG. 14A is an enlarged top view of an exemplary non-planar surface on the cutting face of the cutter element of FIGS. 6A-6D taken in section 14A-14A of FIG. 6B and illustrating an embodiment of a surface finish for reducing friction and drag.
Figure 14B:
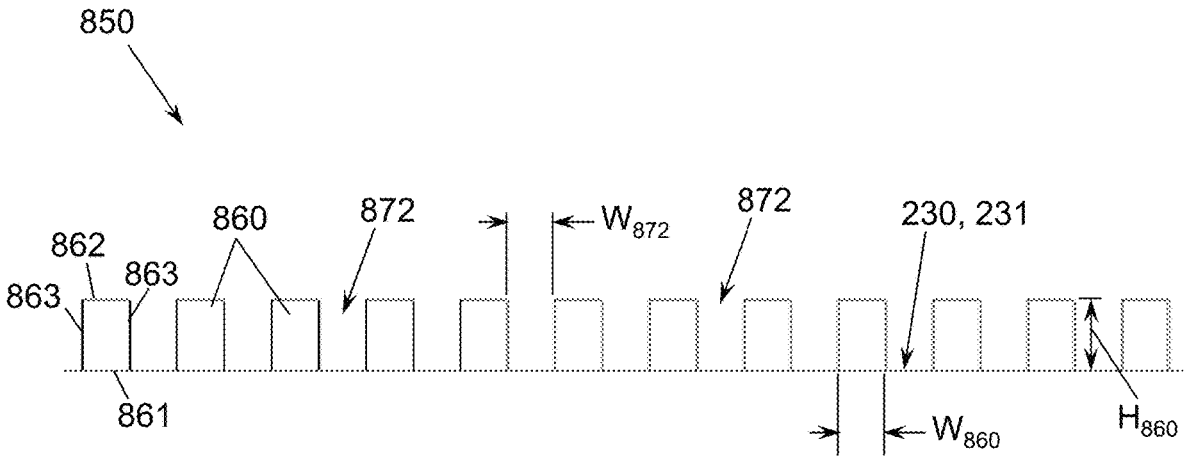
FIG. 14B is a cross-sectional end view of the surface finish of FIG. 14A taken in section 14B-14B of FIG. 14A.
Figure 14C:
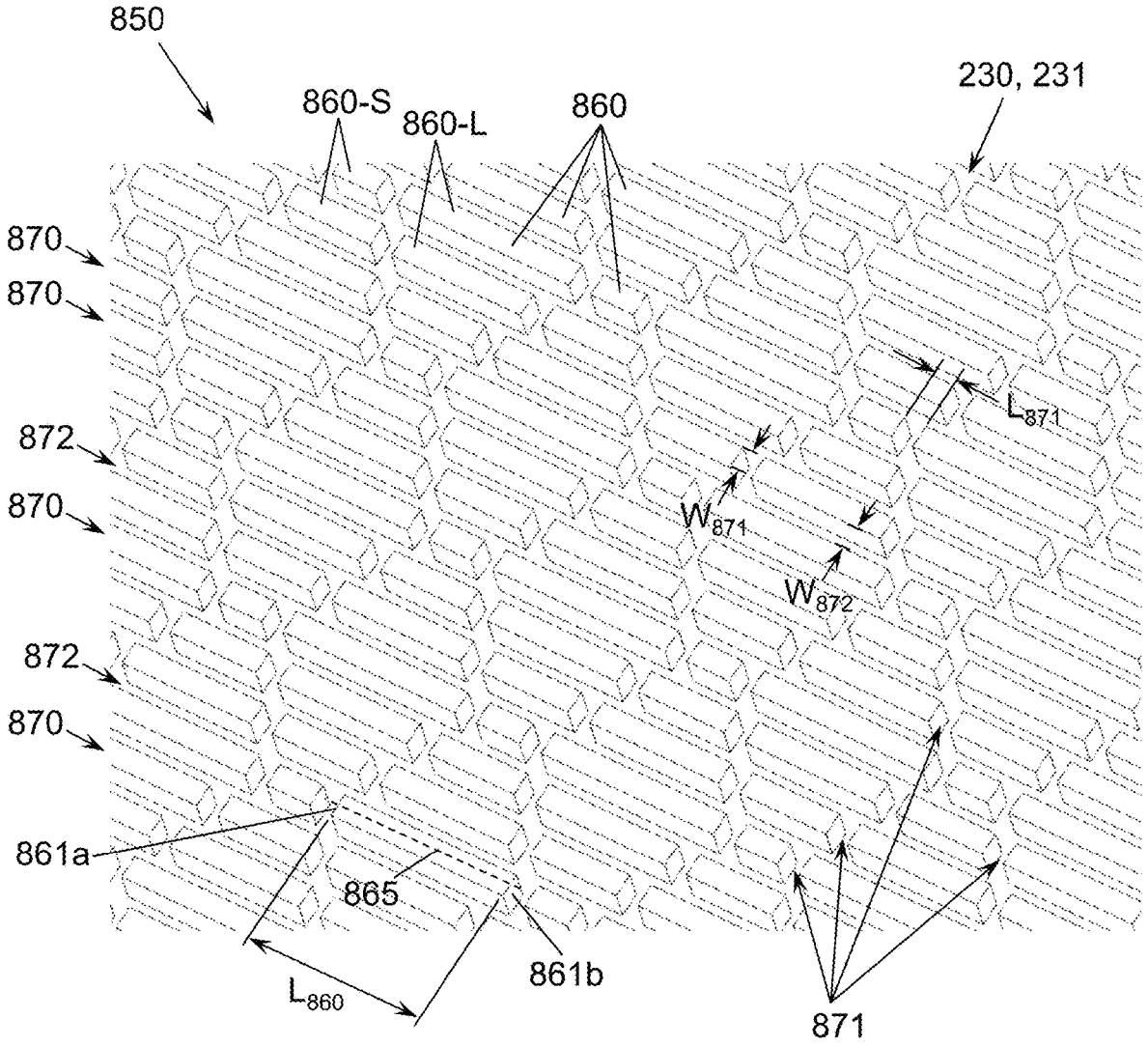
FIG. 14C is a perspective view of the surface finish of FIG. 14A.

Referring now to FIGS. 14A-14C, surface finish 850 of primary cutting surface 230 is shown. In this embodiment, surface finish 850 includes a plurality of elongate, parallel raised ridges 860. Each ridge 860 has a central or longitudinal axis 865, a first end 861*a*, a second end 861*b* opposite the first end 861*a*, and a length $L_{860}$ measured axially (i.e., parallel to axis 865) from first end 861*a* to second end 861*b*. In embodiments described herein, the length $L_{860}$ of each ridge 860 ranges from 25.0 micron to 750.0 micron, and more preferably ranges from 40.0 micron to 160.0 micron.

As best shown in FIGS. 14A and 14C, ridges 860 are arranged in a plurality of laterally adjacent, laterally spaced, parallel rows 870. Each row 870 includes a plurality of axially aligned and axially spaced ridges 860. In this embodiment, two or more ridges 860 within each row 870 have different axial lengths $L_{860}$. More specifically, in this embodiment, the ridges 860 within each row 870 are arranged in an axially alternating pattern of "long" ridges 860 and "short" ridges 860 where the long ridges 860 in the row 870 have lengths $L_{860}$ that are greater than the lengths $L_{860}$ of the short ridges 860 in the same row 870. For purposes of clarity and further explanation, long ridges 860 in each row 870 may also be identified with reference numerals 860-L, and short ridges 860 in each row 870 may also be identified with reference numerals 860-S. In this embodiment, within each row 870, each long ridge 860-L has the same length $L_{860}$ and each short ridge 860-S has the same length $L_{860}$. However, in other embodiments, the longer ridges (e.g., ridges 860-L) may have different lengths (e.g., different lengths length $L_{860}$) and the shorter ridges (e.g., ridges 860-S) may have different lengths (e.g., different lengths length $L_{860}$).

Due to the axial spacing of ridges 860 in the same row 870, a recess 871 is positioned between each pair of axially adjacent ridges 860 in the same row 870. Each recess 871 has an axial length $L_{871}$ measured parallel to the longitudinal axes 865 of ridges 860 and a lateral width $W_{871}$ measured perpendicular to longitudinal axes 865 of ridges 860. In embodiments described herein, the length $L_{871}$ of each recess 871 ranges from 25.0 micron to 500.0 micron, and more preferably ranges from 25.0 micron to 250.0 micron. In this embodiment, each recess 871 (in the same row 870 and in different rows 870) has the same length $L_{871}$. The lateral width $W_{871}$ of each recess 871 is the same as the width of the ridges 860 in the same row 870 as will be described in more detail below.

Referring again to FIGS. 14A to 14C, due to the lateral spacing of laterally adjacent rows 870, an elongate recess 872 is laterally positioned between each pair of laterally adjacent rows 870 and laterally positioned between the ridges 860 in each pair of laterally adjacent rows 870. The recesses 872 between each pair of laterally adjacent rows 870 are oriented parallel to each other, parallel to ridges 860, and parallel to rows 870. In embodiments described herein, each recess 872 extends linearly, parallel to longitudinal axes 865 along the entire length of the laterally adjacent rows 870. In addition, each recess 872 has a lateral width $W_{872}$ that is the same as the width of the ridges 860 in the laterally adjacent rows 870 as will be described in more detail below.

Referring now to FIG. 14B, in this embodiment, each ridge 860 has the same cross-sectional geometry and size, and more specifically, each ridge 860 has the same cross-sectional geometry and size along its entire length $L_{860}$. More specifically, in this embodiment, each ridge 860 has a rectangular cross-sectional geometry including a first or fixed end 861 integral with primary cutting face 230, a second or free end 862 distal primary cutting face 230, and a pair of parallel lateral sides 863 extending from fixed end 861 to free end 862. In this embodiment, lateral sides 863 are planar and extend perpendicularly from primary cutting face 230, and free end 862 is defined by a planar surface extending perpendicularly between lateral sides 863.

Referring still to FIG. 14B, each ridge 860 has a width $W_{860}$ measured perpendicularly between lateral sides 863 and a height $H_{860}$ measured perpendicularly to free end and the corresponding non-planar surface from fixed end 861 to free end 862. In embodiments described herein, the width $W_{860}$ of each ridge 860 ranges from 2.0 micron to 250.0 micron, and more preferably ranges from 3.0 micron to 100.0 micron. In embodiments described herein, the height $H_{860}$ of each ridge 860 ranges from 2.0 micron to 500.0 micron, and more preferably ranges from 2.0 micron to 100.0 micron. As previously described, the lateral width $W_{871}$ of each recess 871 and the lateral width $W_{872}$ of each recess 872 is the same as the width $W_{860}$ of the ridges 860. Although ridges 860 have rectangular cross-sectional geometries in this embodiment, in other embodiments, the ridges of the textured surface finish (e.g., ridges 860 of textured surface finish 850) may have other cross-sectional geometries including triangular, semi-circular, or trapezoidal, but preferably have the cross-sectional dimensions (e.g., widths $W_{860}$ and heights $H_{860}$) as described herein.

Referring now to FIGS. 14A and 14C, in this embodiment, ridges 860 are arranged in a pattern such that no two recesses 871 in laterally adjacent rows 870 are axially aligned moving laterally from one row 870 to the laterally adjacent row 870. In other words, each recess 871 in each row 870 is axially mis-aligned and axially staggered with respect to each recess 871 in each laterally adjacent row 870. For example, movement laterally in FIG. 14A (upward or downward) through any recess 871 in any row 870 toward an adjacent row 870 will result in impacting a ridge 860 in the laterally adjacent row 870 and not passage through a recess 871 in the adjacent row 870. In this embodiment, the ridges 860 in laterally adjacent rows 870 are arranged in a plurality of diamond patterns as best shown in FIGS. 14A and 14C as identified with the dashed line 880.

In general, recesses 870, 871 and ridges 860 can be formed by any suitable means known in the art. In embodiments described herein, recesses 870, 871 and ridges 860 are formed by laser etching to the desired surface(s) to achieve the desired sizing, positioning, and geometry as is known in the art. As described above, a conventional approach to reducing friction between a surface on the cutting face of a cutter element and the formation being cut is to polish the surface. However, polishing may be relatively difficult to do with regard to non-planar surfaces or on select, discrete planar surfaces adjacent other discrete surfaces. In embodiments described herein, surface finish 850 including ridges 860 separated by recesses 870, 871 provided on one or more surfaces of cutting face 221 generally limits the surface area contacting the formation to the surface area defined by ends 862 of ridges 860, thereby offering the potential to reduce friction between such non-planar surfaces and the formation, enhance durability of the corresponding cutter element, and enhance ROP.

Although the embodiment of cutter element 200 shown in FIGS. 6A-6D includes surface finish 850 on primary cutting surface 230 (and corresponding first planar surface 231) and riser 250 (and corresponding surfaces 251, 252) of cutting face 221, in other embodiments, other, additional, or different surfaces on cutting face 221 may include surface treatment 850. However, in embodiments described herein, application of the surface treatment (e.g., surface treatment 850) may be particularly beneficial on the primary cutting surface (e.g., primary cutting surface 230, 330, 530), as well as the riser (e.g., riser 250, 450, 550, 650).

While preferred embodiments have been shown and described, modifications thereof can be made by one skilled in the art without departing from the scope or teachings herein. The embodiments described herein are exemplary only and are not limiting. Many variations and modifications of the systems, apparatus, and processes described herein are possible and are within the scope of the invention. For example, the relative dimensions of various parts, the materials from which the various parts are made, and other parameters can be varied. Accordingly, the scope of protection is not limited to the embodiments described herein, but is only limited by the claims that follow, the scope of which shall include all equivalents of the subject matter of the claims. Unless expressly stated otherwise, the steps in a method claim may be performed in any order. The recitation of identifiers such as (a), (b), (c) or (1), (2), (3) before steps in a method claim are not intended to and do not specify a particular order to the steps, but rather are used to simplify subsequent reference to such steps.

What is claimed is:

1. A cutter element for a fixed cutter drill bit configured to drill a borehole in a subterranean formation, the cutter element comprising:

a base having a central axis, a first end, a second end, and a radially outer cylindrical surface extending axially from the first end to the second end;

a cutting layer fixably mounted to the first end of the base, wherein the cutting layer includes a stepped cutting face distal the base and a radially outer cylindrical surface extending axially from the cutting face to the radially outer cylindrical surface of the base, wherein the radially outer cylindrical surface of the cutting layer is contiguous with the radially outer cylindrical surface of the base;

wherein the stepped cutting face comprises:

a first step;

a second step axially spaced from the first step;

a riser axially positioned between the first step and the second step;

wherein the first step is axially positioned between the riser and the base;

wherein the second step is convex in front view of the cutter element and side view of the cutter element;

wherein the second step comprises a plurality of planar facets including a cutting facet disposed in a plane oriented perpendicular to the central axis of the base and a relief facet extending from the cutting facet, wherein the relief facet is oriented at an acute angle n relative to a plane oriented perpendicular to the central axis of the base.

2. The cutter element of claim 1, wherein the cutting layer has a thickness Tal measured axially from the base to the second step;

wherein the first step is axially spaced from the second step by a distance $D_s$ measured axially from the first step to the second step, wherein the ratio of the distance $D_s$ to the thickness $T_d$ is greater than or equal to 0.25.

3. The cutter element of claim 1, wherein the first step comprises a planar surface disposed in a plane oriented perpendicular to the central axis.

4. The cutter element of claim 3, wherein the riser comprises:

a cylindrical surface; or a plurality of circumferentially adjacent planar surfaces.

5. The cutter element of claim 4, wherein the first step, the second step, and the riser are symmetric about a reference plane that contains the central axis of the base and bisects the cutter element.

6. The cutter element of claim 5, wherein the riser comprises:

a central planar surface;

a first lateral planar surface extending from the central planar surface to the radially outer cylindrical surface of the cutting layer; and a second lateral planar surface extending from the central planar surface to the radially outer cylindrical surface of the cutting layer, wherein the first lateral planar surface and the second lateral planar surfaces are disposed on opposite sides of the reference plane.

7. The cutter element of claim 6, wherein the first lateral planar surface and the second lateral planar surface are angularly spaced apart by an angle θ in a top view of the cutter element, wherein the angle θ ranges from 70° to 140°.

8. The cutter element of claim 6, wherein central planar surface is oriented at an angle σ relative to the central axis of the base in side view of the cutter element, wherein the angle σ ranges from −20° to +20°.

9. The cutter element of claim 8, wherein each lateral planar surface is oriented at an angle β relative to the central axis of the base in side view of the cutter element, wherein the angle β ranges from −15° to +25°.

10. The cutter element of claim 1, wherein the angle η ranges from 1° to 20°.

11. The cutter element of claim 10, wherein the riser has a V-shaped geometry or a W-shaped geometry in top view of the cutter element.

12. The cutter element of claim 10, wherein the first step is convex in front view of the cutter element and side view of the cutter element.

13. The cutter element of claim 1, wherein the first step defines a primary cutting surface comprising a surface finish including a plurality of elongate raised ridges and a plurality of recesses positioned between the raised ridges, wherein the plurality of raised ridges are arranged in a plurality of parallel rows.

14. The cutter element of claim 13, wherein each of the plurality of raised ridges has a linear central axis, a first end, a second end opposite the first end, a length measured axially from the first end to the second end, and a width measured perpendicular to the central axis;

wherein the plurality of raised ridges are oriented parallel to each other;

wherein the width of each raised ridge ranges from 2.0 micron to 250.0 micron; and wherein the length of each raised ridge ranges from 25.0 micron to 750.0 micron.

15. A cutter element for a fixed cutter drill bit configured to drill a borehole in a subterranean formation, the cutter element comprising:

a substrate having a central axis, a first end, a second end, and a radially outer cylindrical surface extending axially from the first end to the second end;

a cutting layer having a first end distal the substrate, a second end fixably attached to the first end of the substrate, and a radially outer cylindrical surface extending from the first end of the cutting layer to the second end of the cutting layer, wherein the first end of the cutting layer includes a stepped cutting face, wherein the radially outer cylindrical surface of the cutting layer is contiguous with the radially outer cylindrical surface of the base;

wherein the stepped cutting face comprises:

a primary cutting surface extending from a first cutting tip of the cutter element, wherein the first cutting tip is configured to engage and shear the subterranean formation, wherein the first cutting tip is positioned at an intersection of the primary cutting surface and a first bevel;

a secondary cutting surface axially spaced from the primary cutting surface, wherein the secondary cutting surface extends from a second cutting tip of the cutter element, wherein the second cutting tip is configured to engage and shear the subterranean formation, wherein the second cutting tip is positioned at an intersection of the secondary cutting surface and a second bevel;

a riser axially positioned between the primary cutting surface and the secondary cutting surface;

wherein the primary cutting surface is axially positioned between the secondary cutting surface and the substrate;

wherein the secondary cutting surface is convex in front view of the cutter element and side view of the cutter element;

wherein the secondary cutting surface comprises a plurality of planar facets including:

a planar cutting facet extending from the second cutting tip and disposed in a plane oriented perpendicular to the central axis of the base; and a planar relief facet extending from the cutting facet, wherein the planar relief facet slopes toward the substrate moving radially from the planar cutting facet;

wherein the primary cutting surface is configured to engage and shear the subterranean formation before the secondary cutting surface.

16. The cutter element of claim 15, wherein the first bevel extends from the primary cutting surface to the radially outer cylindrical surface of the cutting layer, and wherein the second bevel extends from the secondary cutting surface to the riser.

17. The cutter element of claim 16, wherein the cutting layer has a thickness $T_{cl}$ measured axially from the substrate to the secondary cutting surface;

wherein the primary cutting surface is axially spaced from the secondary cutting surface by a distance $D_s$ measured axially from the primary cutting surface to the secondary cutting surface, wherein the ratio of the distance $D_s$ to the thickness $T_d$ is greater than or equal to 0.25.

18. The cutter element of claim 16, wherein the primary cutting surface comprises a planar surface disposed in a plane oriented perpendicular to the central axis.

19. The cutter element of claim 18, wherein the riser comprises:

a cylindrical surface extending axially from the primary cutting surface to the second bevel; or a plurality of circumferentially adjacent planar surfaces including a central planar surface extending axially from the primary cutting surface to the second bevel.

20. The cutter element of claim 19, wherein the riser comprises:

the central planar surface;

a first lateral planar surface extending laterally from the central planar surface to the radially outer cylindrical surface of the cutting layer; and a second lateral planar surface extending laterally from the central planar surface to the radially outer cylindrical surface of the cutting layer.

21. The cutter element of claim 20, wherein the first lateral planar surface and the second lateral planar surface are angularly spaced apart by an angle θ in a top view of the cutter element, wherein the angle θ ranges from 70° to 140°;

wherein central planar surface is oriented at an angle σ relative to the central axis of the substrate in side view of the cutter element, wherein the angle σ ranges from −20° to +20°;

wherein each lateral planar surface is oriented at an angle β relative to the central axis of the substrate in side view of the cutter element, wherein the angle β ranges from −15° to +25°.

22. The cutter element of claim 15, wherein the riser has a V-shaped geometry or a W-shaped geometry in top view of the cutter element.

23. The cutter element of claim 15, wherein the primary cutting surface comprises a surface finish including a plurality of elongate raised ridges and a plurality of recesses positioned between the raised ridges, wherein the plurality of raised ridges are arranged in a plurality of parallel rows.

24. The cutter element of claim 23, wherein each of the plurality of raised ridges has a linear central axis, a first end, a second end opposite the first end, a length measured axially from the first end to the second end, and a width measured perpendicular to the central axis;

wherein the plurality of raised ridges are oriented parallel to each other;

wherein the width of each raised ridge ranges from 2.0 micron to 250.0 micron; and wherein the length of each raised ridge ranges from 25.0 micron to 750.0 micron.

25. A cutter element for a fixed cutter drill bit configured to drill a borehole in a subterranean formation, the cutter element comprising:

a substrate having a central axis, a first end, a second end, and a radially outer cylindrical surface extending axially from the first end to the second end;

a cutting layer having a first end distal the substrate, a second end fixably attached a cutting layer having a first end distal to the first end of the substrate, and a radially outer cylindrical surface extending from the first end the cutting layer to the second end of the cutting layer, where the first end of the cutting layer includes a stepped cutting face, wherein the radially outer cylindrical surface of the cutting layer is contiguous with the radially outer cylindrical surface of the base;

wherein the stepped cutting face comprises:

a primary cut surface tending from a first in cutter element, wherein the first cutting tip is configured to gage and shear the subterranean formation, wherein the first cutting tip is positioned at an intersection of the primary cutting surface and first bevel;

a secondary cutting surface axially spaced from the primary cutting surface, wherein the secondary cutting e extends from a second cutting tip of the cutter element, wherein the second cutting tip s configured to engage and shear the subterranean formation, wherein the second cutting tip is positioned at an intersection of the secondary cutting surface and a second bevel;

a riser ax ally positioned between the primary cutting surface and the secondary cutting surface;

wherein the primary cutting surface is axially positioned between the secondary cutting surface and the substrate;

wherein the primary cutting surface is configured to engage and shear the subterranean formation before the secondary cutting surface;

wherein the first bevel extends from the primary cutting surface to the radially outer cylindrical surface of the cutting layer, and wherein the second bevel extends from the secondary cutting surface to the riser;

wherein the first cutting tip is radially aligned with the second cutting tip, and wherein the first cutting tip and the second cutting tip are radially spaced apart a radial offset distance R measured radially from the first cutting tip to the second cutting tip in top view, wherein the radial offset distance R ranges from 0.45 mm to 2.0 mm.

26. The cutter element of claim 25, wherein first cutting tip, the second cutting tip, and the riser are symmetric about a reference plane that contains the central axis of the base and bisects the cutter element.

* * * * *